US009524675B2

(12) United States Patent
Wei et al.

(10) Patent No.: US 9,524,675 B2
(45) Date of Patent: Dec. 20, 2016

(54) SHIFT REGISTER, GATE DRIVER CIRCUIT WITH LIGHT EMISSION FUNCTION, AND METHOD FOR DRIVING THE SAME

(71) Applicants: BOE TECHNOLOGY GROUP CO., LTD., Beijing (CN); Chengdu BOE Optoelectronics Technology Co., Ltd., Chengdu, Sichuan Province (CN)

(72) Inventors: Dongmei Wei, Beijing (CN); Haigang Qing, Beijing (CN); Yin Deng, Beijing (CN)

(73) Assignees: BOE TECHNOLOGY GROUP CO., LTD., Beijing (CN); Chengdu BOE Optoelectronics Technology Co., Ltd., Chengdu, Sichuan Province (CN)

( * ) Notice: Subject to any disclaimer, the term of this patent is extended or adjusted under 35 U.S.C. 154(b) by 88 days.

(21) Appl. No.: 14/552,806

(22) Filed: Nov. 25, 2014

(65) Prior Publication Data

US 2016/0019833 A1 Jan. 21, 2016

(30) Foreign Application Priority Data

Jul. 16, 2014 (CN) ..... 2014 1 0339273

(51) Int. Cl.
*G09G 3/3266* (2016.01)
*G09G 3/3233* (2016.01)
*G09G 3/32* (2016.01)

(52) U.S. Cl.
CPC ..... *G09G 3/3266* (2013.01); *G09G 3/3233* (2013.01); *G09G 2300/0819* (2013.01);
(Continued)

(58) Field of Classification Search
CPC .. G09G 3/3225; G09G 3/3233; G09G 3/3258; G09G 3/3266; G09G 3/3674; G09G 3/3677; G09G 2310/0286; G09G 2310/0278; G09G 2310/0262; G09G 2300/0861; G09G 2300/0819; G09G 2300/0842
See application file for complete search history.

(56) References Cited

U.S. PATENT DOCUMENTS

2010/0245301 A1* 9/2010 Shang ..... G09G 3/3677 345/204
2013/0342584 A1* 12/2013 Song ..... G09G 3/3266 345/690
(Continued)

*Primary Examiner* — Larry Sternbane
*Assistant Examiner* — Darlene M Ritchie
(74) *Attorney, Agent, or Firm* — Kinney & Lange, P.A.

(57) ABSTRACT

The present disclosure presents a shift register and a gate driver circuit comprising a signal input unit, a reset control unit, a light emitting signal output control unit, and a scanning signal output control unit. At a charging phase, the signal input unit controls the light emitting signal output control unit to conductively connect the first reference signal terminal to the light emitting signal output terminal, and controls the scanning signal output control unit to conductively connect the second clock signal terminal to the scanning signal output terminal. At a scanning signal output phase, the scanning signal output terminal outputs a scanning signal. At a light emitting signal output phase, the light emitting signal output terminal outputs a light emitting signal. The above shift register provided according to an embodiment of the present disclosure integrates the function of outputting scanning signals and the function of outputting light emitting signals.

19 Claims, 16 Drawing Sheets

(52) U.S. Cl.
CPC ..... *G09G 2300/0842* (2013.01); *G09G 2300/0861* (2013.01); *G09G 2310/0262* (2013.01); *G09G 2310/0278* (2013.01); *G09G 2310/0286* (2013.01)

(56) References Cited

U.S. PATENT DOCUMENTS

| | | | | |
|---|---|---|---|---|
| 2015/0035733 | A1* | 2/2015 | Woo ..... | G09G 3/3266 345/76 |
| 2015/0170568 | A1* | 6/2015 | Lee ..... | G11C 19/287 345/690 |

* cited by examiner

SHIFT REGISTER, GATE DRIVER CIRCUIT WITH LIGHT EMISSION FUNCTION, AND METHOD FOR DRIVING THE SAME

CROSS-REFERENCE TO RELATED APPLICATION(S)

This application claims priority to Chinese Application No. 201410339273.9, filed on Jul. 16, 2014, which is incorporated herein by reference in its entirety.

TECHNICAL FIELD

The present disclosure relates to the field of display technology, and in particular, to a shift register, a gate driver circuit, and a method for driving a gate driver circuit.

BACKGROUND

Organic Light Emitting Diode (OLED) is one of the hotspots in the field of panel display technology. As compared with a liquid crystal display, an OLED presents a number of advantages, such as, lower energy consumption, lower production cost, self-luminescence, a wider viewing angle, and a faster response speed. At present, in the field of display, for example, mobile phones, PDAs, digital cameras, conventional LCD displays are being replaced with OLEDs. An OLED is driven by current and its luminescence is controlled by a stable current, which is different from an LCD for which the luminance is controlled by a stable voltage. Due to processing technologies and device aging, a threshold voltage $V_{th}$ of a driver transistor used for driving an OLED may be uneven, and therefore the current which passes through the OLED of each pixel varies and the luminance is not even. In this way, the display effect for the whole image is impacted.

Therefore, in an existing pixel driver circuit for driving an OLED to emit light, the impact due to threshold voltages of driver transistors will usually be eliminated. To be specific, as shown in FIG. 1A, a very typical OLED pixel driver circuit comprises: a driver transistor T2, switching transistors T1, T3, T4, T5, and T6, a storage capacitor C, and a light emitting device OLED, where the gate of the switching transistor T1 is connected to a second light emitting signal input terminal EM(n+1), its source is connected to a first reference signal terminal ELVDD, and its drain is connected to one terminal of the storage capacitor C and the source of the driver transistor T2, respectively; the gate of the driver transistor T2 is connected to the drain of the switching transistor T3 and the drain of the switching transistor T6, respectively, and its drain is connected to one terminal of the light emitting device OLED; the gate of the switching transistor T3 is connected to a second light emitting signal input terminal EM(n+1), its source is connected to the other terminal of the storage capacitor C, the drain of the switching transistor T4, and the drain of the switching transistor T5, respectively; the gate of the switching transistor T4 is connected to a first scanning signal input terminal S(n−1), and its source is connected to a second reference signal terminal Vref and the source of the switching transistor T5, respectively; the gate of the switching transistor T5 is connected to a second scanning signal input terminal S(n) and the gate of the switching transistor T6, respectively; the source of the switching transistor T6 is connected to a data voltage signal input terminal Vdata; and the other terminal of the light emitting device OLED is connected to a third reference signal terminal ELVSS.

FIG. 1B is a timing diagram of a pixel driver circuit shown in FIG. 1A. In FIG. 1B, the signal S(n−1) is a control signal that is input from an output terminal of a shift register at the $(N-1)^{th}$ stage in a gate driver circuit into a first scanning signal input terminal S(n−1) in a pixel driver circuit as shown in FIG. 1A. The signal S(n) is a control signal that is input from an output terminal of a shift register at the $N^{th}$ stage in the gate driver circuit into the second scanning signal input terminal S(n) in the pixel driver circuit as shown in FIG. 1A. The signal EM(n) is a control signal that is input from an output terminal at the $N^{th}$ stage in a light emitting driver circuit into a first light emitting signal input terminal EM(n) in the pixel driver circuit at an upper stage that is neighboring to the pixel driver circuit as shown in FIG. 1A. The signal EM(n+1) is a control signal that is input from an output terminal at the $(N+1)^{th}$ stage in the light emitting driver circuit into the second light emitting signal input terminal EM(n+1) in the pixel driver circuit as shown in FIG. 1A. Under the control of the three control signal terminals, i.e., the first scanning signal input terminal S(n−1), the second scanning signal input terminal S(n), and the second light emitting signal input terminal EM(n+1), the pixel driver circuit as shown in FIG. 1A may have four operation phases: the first phase in which the first scanning signal input terminal S(n−1) and the second light emitting signal input terminal EM(n+1) cause the switching transistor T1, the switching transistor T3, and the switching transistor T4 to turn on, and the pixel driver circuit accomplishes the initialization on the gate of the driver transistor T2 in addition to charging the capacitor C through the second reference signal terminal Vref and the first reference signal terminal ELVDD; the second phase in which the second scanning signal input terminal S(n) causes the switching transistor T5 and the switching transistor T6 to turn on, the data voltage is written and the threshold voltage is compensated for the driver transistor T2, and the second light emitting signal input EM(n+1) causes the switching transistor T1 and the switching transistor T3 to turn off; the third phase in which all the switching transistors turn off to prevent any noise from being generated by switching; and the fourth phase (a light emitting phase) in which the second light emitting signal input terminal EM(n+1) causes the switching transistor T1 and the switching transistor T3 to turn on, at the same time the first scanning signal input terminal S(n−1) and the second scanning signal input terminal S(n) cause rest of the switching transistors to turn off, the driver transistor T2 turns on due to the written data voltage to drive the light emitting device OLED to emit light.

From the above description, it can be determined that respective control signals are input from the gate driver circuit and the light emitting driver circuit to the first scanning signal input terminal S(n−1), the second scanning signal input terminal S(n), and the light emitting signal input terminal EM(n+1) of the pixel driver circuit at various operation phases of the pixel driver circuit, such that the pixel driver circuit is controlled to accomplish respective operations at various phases. However, in the related art, the gate driver circuit and the light emitting driver circuit for providing scanning signals and light emitting signals to various pixel driver circuits are disposed in a non-display region of a display panel independently and separately. Such a circuit design is relatively complex and not suitable for development of a display panel with narrow rims.

SUMMARY

Embodiments according to the present disclosure provide a shift register and a gate driver circuit for achieving a function of providing a pixel driver circuit with scanning signals and light emitting signals by a shift register.

An embodiment of the present disclosure provides a shift register comprising: a signal input unit, a reset control unit, a light emitting signal output control unit, and a scanning signal output control unit, wherein the signal input unit has an input terminal connected to a first reference signal terminal, a first control terminal connected to a first clock signal terminal, a second control terminal connected to a signal input terminal, a first output terminal connected to a first node, and a second output terminal connected to a second node;

wherein the reset control unit has an input terminal connected to a second reference signal terminal, a control terminal connected to a reset signal terminal, and an output terminal connected to the second node;

wherein the light emitting signal output control unit has a first input terminal connected to the first reference signal terminal, a second input terminal connected to the second reference signal terminal, a first control terminal connected to the first node, a second control terminal connected to the second node, and an output terminal connected to a light emitting signal output terminal;

wherein the scanning signal output control unit has a first input terminal connected to a second clock signal terminal, a second input terminal connected to the first reference signal terminal, a third input terminal connected to the second reference signal terminal, a first control terminal connected to the first node, a second control terminal connected to an output terminal of the light emitting signal output control unit, and an output terminal connected to a scanning signal output terminal;

wherein at a charging phase, under the control of the first clock signal terminal and the signal input terminal, the signal input unit controls, via the first node, the light emitting signal output control unit to conductively connect the first reference signal terminal to the light emitting signal output terminal, and controls the scanning signal output control unit to conductively connect the second clock signal terminal to the scanning signal output terminal;

wherein at a scanning signal output phase, the light emitting signal output control unit conductively connects the first reference signal terminal to the light emitting signal output terminal, the scanning signal output control unit conductively connects the second clock signal terminal to the scanning signal output terminal, and the scanning signal output terminal outputs a scanning signal under the control of the second clock signal terminal;

wherein at a light emitting signal output phase, under the control of the reset signal terminal and the second reference signal terminal, the reset control unit controls, via the second node, the light emitting signal output control unit to conductively connect the second reference signal terminal to the light emitting signal output terminal such that the light emitting signal output terminal outputs a light emitting signal, and the scanning signal output control unit conductively connects the first reference signal terminal to the scanning signal output terminal under the control of the light emitting signal output terminal.

According to a possible implementation, in the above shift register provided by an embodiment of the present disclosure, the scanning signal output control unit comprises: a first control module and a second control module, wherein the first control module has a first input terminal connected to the first reference signal terminal, a second input terminal connected to the second reference signal terminal, a first control terminal connected to the first node, a second control terminal connected to the light emitting signal output terminal, and an output terminal connected to the scanning signal output terminal, and the first control module is used for conductively connecting the first reference signal terminal to the scanning signal output terminal at the light emitting signal output phase; and wherein the second control module has an input terminal connected to the second clock signal terminal, a control terminal connected to the first node, and an output terminal connected to the scanning signal output terminal, and the second control module is used for conductively connecting the second clock signal terminal to the scanning signal output terminal at the charging phase and the scanning signal output phase, and used for causing the scanning signal output terminal to output a scanning signal at the scanning signal output phase.

According to a possible implementation, in the above shift register provided by an embodiment of the present disclosure, the first control module comprises: a first switching transistor, a second switching transistor, and a third switching transistor, wherein the first switching transistor has a gate connected to the light emitting signal output terminal, a source connected to a drain of the second switching transistor, and a drain connected to the second reference signal terminal;

wherein the second switching transistor has a gate connected the first node, a source connected to the first reference signal terminal, and a drain connected to a source of the first switching transistor;

wherein the third switching transistor has a gate connected to a source of the first switching transistor and a drain of the second switching transistor, respectively, a source connected to the first reference signal terminal, and a drain connected to the scanning signal output terminal.

According to a possible implementation, in the above shift register provided by an embodiment of the present disclosure, the second control module comprises: a fourth switching transistor and a first capacitor, wherein the fourth switching transistor has a gate connected to the first node, a source connected to the second clock signal terminal, and a drain connected to the scanning signal output terminal;

wherein the first capacitor is connected between the first node and the scanning signal output terminal.

According to a possible implementation, in the above shift register provided by an embodiment of the present disclosure, the light emitting signal output control unit comprises: a third control module and a fourth control module, wherein the third control module has an input terminal connected to the first reference signal terminal, a control terminal connected to the first node, and an output terminal connected to the light emitting signal output terminal, and the third control module is used for conductively connecting the first reference signal terminal to the light emitting signal output terminal at the charging phase and the scanning signal output phase;

wherein the fourth control module has an input terminal connected to the second reference signal terminal, a control terminal connected to the second node, and an output terminal connected to the light emitting signal output terminal, and the fourth control module is used for conductively connecting the second reference signal terminal to the light emitting signal output terminal at the light emitting signal output phase, such that the light emitting signal output terminal outputs a light emitting signal.

According to a possible implementation, in the above shift register provided by an embodiment of the present disclosure, the third control module comprises: a fifth switching transistor, wherein the fifth switching transistor has a gate connected to the first node, a source connected to the first reference signal terminal, and a drain connected to the light emitting signal output terminal.

According to a possible implementation, in the above shift register provided by an embodiment of the present disclosure, the fourth control module comprises: a sixth switching transistor, wherein the sixth switching transistor has a gate connected to the second node, a source connected to the light emitting signal output terminal, and a drain connected to the second reference signal terminal.

According to a possible implementation, in the above shift register provided by an embodiment of the present disclosure, the signal input unit comprises: a seventh switching transistor and an eighth switching transistor, wherein the seventh switching transistor has a gate connected to the first clock signal terminal, a source connected to the first node, and a drain connected to the signal input terminal;

wherein the eighth switching transistor has a gate connected to the signal input terminal, a source connected to the first reference signal terminal, and a drain connected to the second node.

According to a possible implementation, in the above shift register provided by an embodiment of the present disclosure, the reset control unit comprises: a ninth switching transistor and a second capacitor, wherein the ninth switching transistor has a gate connected to the reset signal terminal, a source connected to the second node, and a drain connected to the second reference signal terminal;

wherein the second capacitor is connected between the second node and the second reference signal terminal.

According to a possible implementation, in the above shift register provided by an embodiment of the present disclosure, the shift register further comprises: a first node maintaining unit, wherein the first node maintaining unit has an input terminal connected to the first reference signal terminal, a control terminal connected to the second node, and an output terminal connected to the first node, and the first node maintaining unit is used for maintaining the potential of the first node under the control of the second node at the light emitting signal output phase.

According to a possible implementation, in the above shift register provided by an embodiment of the present disclosure, the first node maintaining unit comprises: a tenth switching transistor, wherein the tenth switching transistor has a gate connected to the second node, a source connected to the first reference signal terminal, and a drain connected to the first node.

According to a possible implementation, in the above shift register provided by an embodiment of the present disclosure, the shift register further comprises: a second node maintaining unit, wherein the second node maintaining unit has an input terminal connected to the first reference signal terminal, a control terminal connected to the first node, and an output terminal connected to the second node, and the second node maintaining unit is used for maintaining the potential of the second node under the control of the first node at the charging phase and the scanning signal output phase.

According to a possible implementation, in the above shift register provided by an embodiment of the present disclosure, the second node maintaining unit comprises: a eleventh switching transistor, wherein the eleventh switching transistor has a gate connected to the first node, a source connected to the first reference signal terminal, and a drain connected to the second node.

An embodiment of the present disclosure provides a gate driver circuit comprising multiple (at least three) shift registers, which are connected in series, provided by an embodiment of the present disclosure. Except for the first shift register and the last shift register, a scanning signal output terminal of each of shift registers is connected to a signal input terminal of a next neighboring shift register, and to a reset signal terminal of a previous neighboring shift register; a scanning signal output terminal of the first shift register is connected to a signal input terminal of the second shift register; and a scanning signal output terminal of the last shift register is connected to a rest signal terminal of itself and a reset signal terminal of the previous shift register.

An embodiment of the present disclosure further provides a driving method, the method being applied to a gate driver circuit provided according to an embodiment of the present disclosure, the method comprising: providing, at a first clock signal terminal and a second clock signal terminal, a first clock signal and a second clock signal in antiphase, respectively; and providing, at a signal input terminal of the first shift register, an input signal that is in-phase with the first clock signal.

In the above shift register and gate driver circuit provided by embodiments of the present disclosure, at the charging phase, under the control of the first clock signal terminal and the signal input terminal, the signal input unit controls, via the first node, the light emitting signal output control unit to conductively connect the first reference signal terminal to the light emitting signal output terminal, and controls the scanning signal output control unit to conductively connect the second clock signal terminal to the scanning signal output terminal; at the scanning signal output phase, the light emitting signal output control unit conductively connects the first reference signal terminal to the light emitting signal output terminal, the scanning signal output control unit conductively connects the second clock signal terminal to the scanning signal output terminal, and the scanning signal output terminal outputs a scanning signal under the control of the second clock signal terminal to achieve the function of outputting the scanning signals; at the light emitting signal output phase, under the control of the reset signal terminal and the second reference signal terminal, the reset control unit controls, via the second node, the light emitting signal output control unit to conductively connect the second reference signal terminal to the light emitting signal output terminal such that the light emitting signal output terminal outputs a light emitting signal to achieve the function of outputting the light emitting signals, and the scanning signal output control unit conductively connects the first reference signal terminal to the scanning signal output terminal under the control of the light emitting signal output terminal. In this way, one pixel driver circuit is driven to operate by three neighboring shift registers in the gate driver circuit. The scanning signal output terminal of the first shift register inputs scanning signals into the first scanning signal input terminal of the pixel driver circuit, the scanning signal output terminal of the second shift register inputs scanning signals into the second scanning signal input terminal of the pixel driver circuit, and the light emitting signal output terminal of the third shift register inputs light emitting signals into the light emitting signal input terminal of the pixel driver circuit, thereby driving the pixel driver circuit to operate normally at various phases. Embodiments of the present disclosure provide the above shift register which integrates the functions of outputting scanning signals and light emitting signals. In this way, the light emitting driver circuit disposed at rims of an OLED display panel for providing various pixel driver circuits with the light emitting signals may be omitted, and this helps in designing a display panel with narrow rims.

DETAILED DESCRIPTION

A detailed description of specific implementations of a shift register and a gate driver circuit provided according to an embodiment of the present disclosure will be given below with reference to the figures.

Figure 1A:
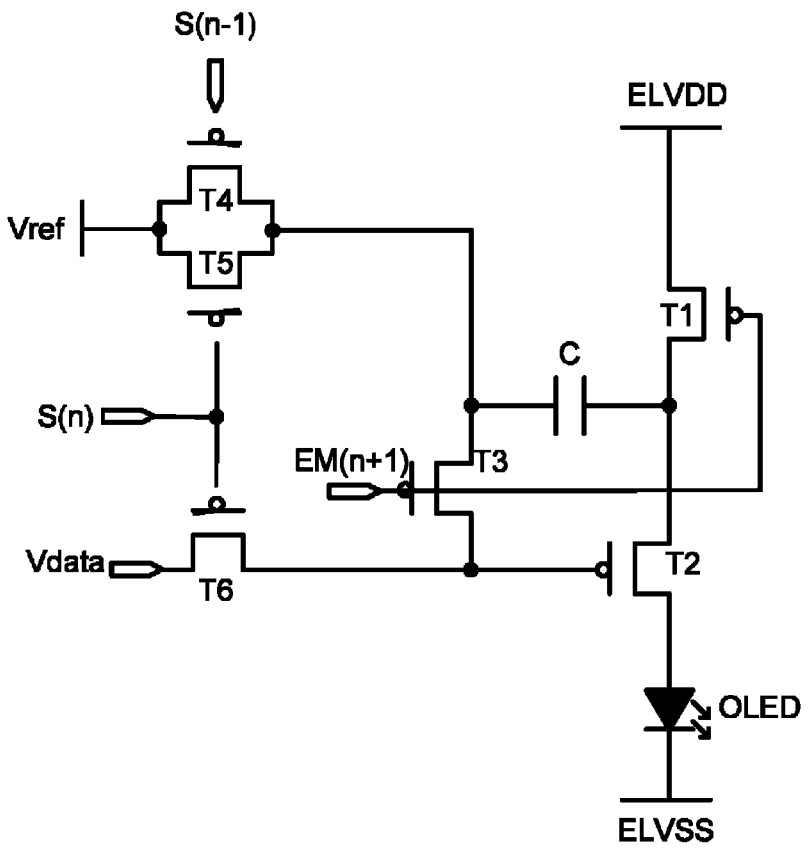
FIG. 1A (PRIOR ART)
FIG. 1A is a structural diagram showing a pixel driver circuit in the related art.
Figure 1B:
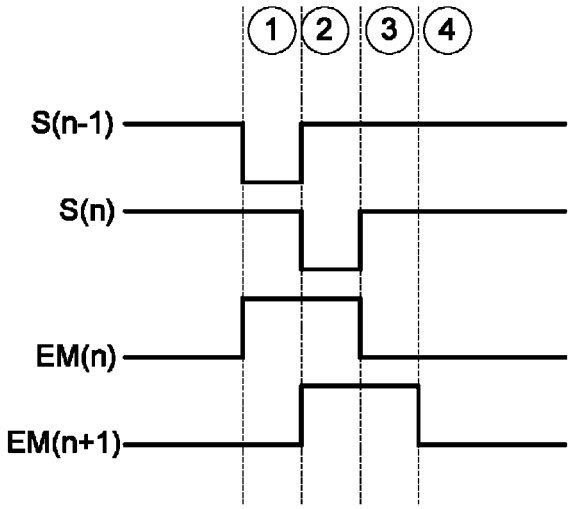
FIG. 1B (PRIOR ART)
FIG. 1B is a timing diagram of a pixel driver circuit shown in FIG. 1A.
Figure 2:
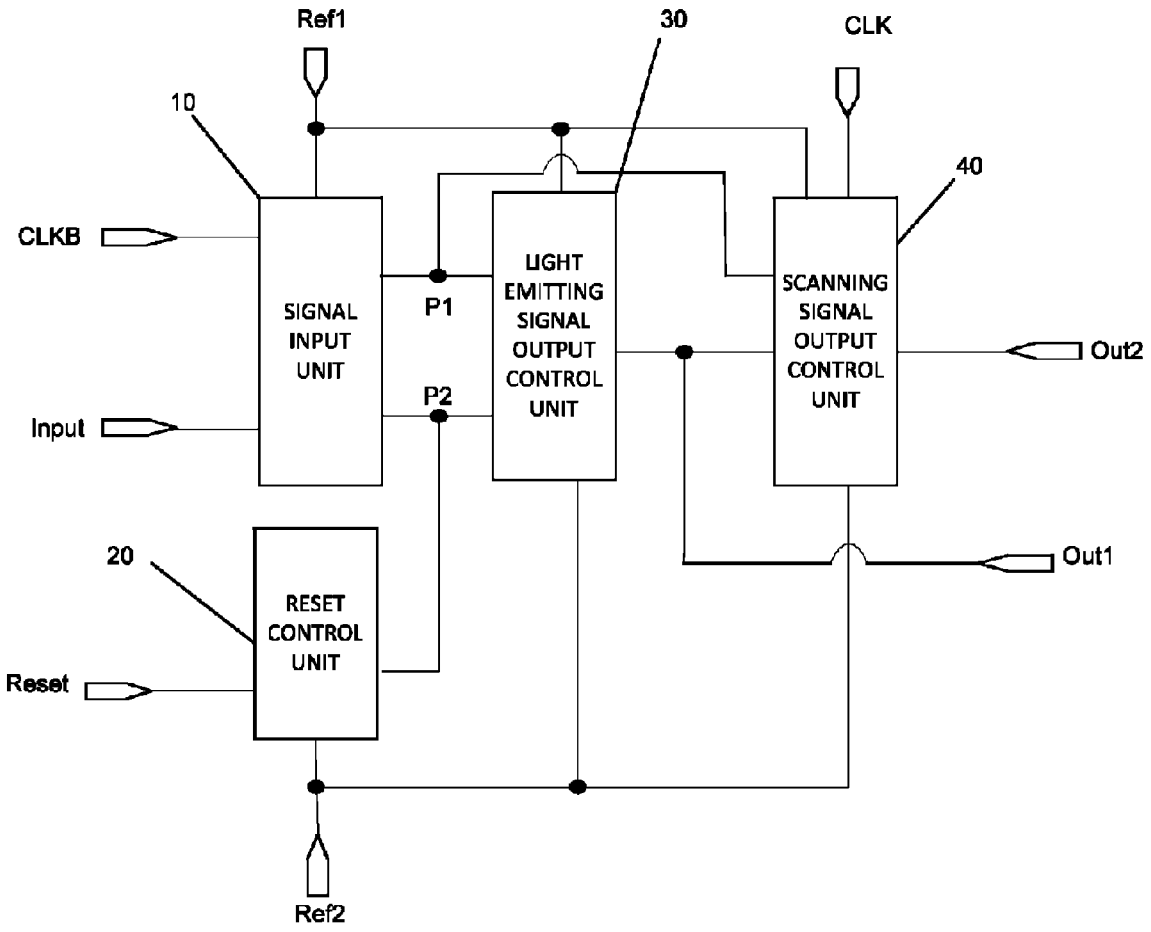
FIG. 2 is a first structural diagram showing a shift register provided according to an embodiment of the present disclosure.

An embodiment of the present disclosure provides a shift register, as shown in FIG. 2, comprising: a signal input unit 10, a reset control unit 20, a light emitting signal output control unit 30, and a scanning signal output control unit 40.

The signal input unit 10 has an input terminal connected to a first reference signal terminal Ref1, a first control terminal connected to a first clock signal terminal CLKB, a second control terminal connected to a signal input terminal "Input", a first output terminal connected to a first node P1, and a second output terminal connected to a second node P2.

The reset control unit 20 has an input terminal connected to a second reference signal terminal Ref2, a control terminal connected to a reset signal terminal Reset, and an output terminal connected to the second node P2.

The light emitting signal output control unit 30 has a first input terminal connected to the first reference signal terminal Ref1, a second input terminal connected to the second reference signal terminal Ref2, a first control terminal connected to the first node P1, a second control terminal connected to the second node P2, and an output terminal connected to a light emitting signal output terminal Out1.

The scanning signal output control unit 40 has a first input terminal connected to a second clock signal terminal CLK, a second input terminal connected to the first reference signal terminal Ref1, a third input terminal connected to the second reference signal terminal Ref2, a first control terminal connected to the first node P1, a second control terminal connected to an output terminal of the light emitting signal output control unit 30, and an output terminal connected to a scanning signal output terminal Out2.

At a charging phase, under the control of the first clock signal terminal CLKB and the signal input terminal "Input", the signal input unit 10 controls, via the first node P1, the light emitting signal output control unit 30 to conductively connect the first reference signal terminal Ref1 to the light emitting signal output terminal Out1, and controls the scanning signal output control unit 40 to conductively connect the second clock signal terminal CLK to the scanning signal output terminal Out2.

At a scanning signal output phase, the light emitting signal output control unit 30 conductively connects the first reference signal terminal Ref1 to the light emitting signal output terminal Out1, the scanning signal output control unit 40 conductively connects the second clock signal terminal CLK to the scanning signal output terminal Out2, and the scanning signal output terminal Out2 outputs a scanning signal under the control of the second clock signal terminal CLK.

At a light emitting signal output phase, under the control of the reset signal terminal Reset and the second reference signal terminal Ref2, the reset control unit 20 controls, via the second node P2, the light emitting signal output control unit 30 to conductively connect the second reference signal terminal Ref2 to the light emitting signal output terminal Out1 such that the light emitting signal output terminal Out1 outputs a light emitting signal, and the scanning signal output control unit 40 conductively connects the first reference signal terminal Ref1 and the scanning signal output terminal Out2 under the control of the light emitting signal output terminal Out1.

In the above shift register provided by embodiments of the present disclosure, at the charging phase, under the control of the first clock signal terminal CLKB and the signal input terminal "Input", the signal input unit 10 controls, via the first node P1, the light emitting signal output control unit 30 to conductively connect the first reference signal terminal Ref1 to the light emitting signal output terminal Out1, and controls the scanning signal output control unit 40 to conductively connect the second clock signal terminal CLK to the scanning signal output terminal Out2; at the scanning signal output phase, the light emitting signal output control unit 30 conductively connects the first reference signal terminal Ref1 to the light emitting signal output terminal Out1, the scanning signal output control unit 40 conductively connects the second clock signal terminal CLK to the scanning signal output terminal Out2, and the scanning signal output terminal Out2 outputs a scanning signal under the control of the second clock signal terminal CLK to achieve the function of outputting the scanning signals; at the light emitting signal output phase, under the control of the reset signal terminal Reset and the second reference signal terminal Ref2, the reset control unit 20 controls, via the second node P2, the light emitting signal output control unit 30 to conductively connect the second reference signal terminal Ref2 to the light emitting signal output terminal Out1 such that the light emitting signal output terminal Out1 outputs a light emitting signal to achieve the function of outputting the light emitting signals, and the scanning signal output control unit 40 conductively connects the first reference signal terminal Ref1 to the scanning signal output terminal Out2 under the control of the light emitting signal output terminal Out1. The above shift register provided according to an embodiment of the present disclosure integrates the functions of outputting scanning signals and light emitting signals. At the scanning signal output phase, the scanning signal output terminal Out2 outputs a scanning signal to a scanning signal input terminal of an OLED pixel driver circuit connected thereto. At the light emitting signal output phase, the light emitting signal output terminal Out1 outputs a light emitting signal to a light emitting signal input terminal of an OLED pixel driver circuit connected thereto. In this way, the light emitting driver circuits for providing light emitting signals to various pixel driver circuits, that are disposed at rims of an OLED display panel independently, may be omitted. This helps in a narrow rim design for a display panel.

Next, detailed descriptions for specific structures of individual units of the above shift register provided according to an embodiment of the present disclosure will be given below.

Figure 3A:
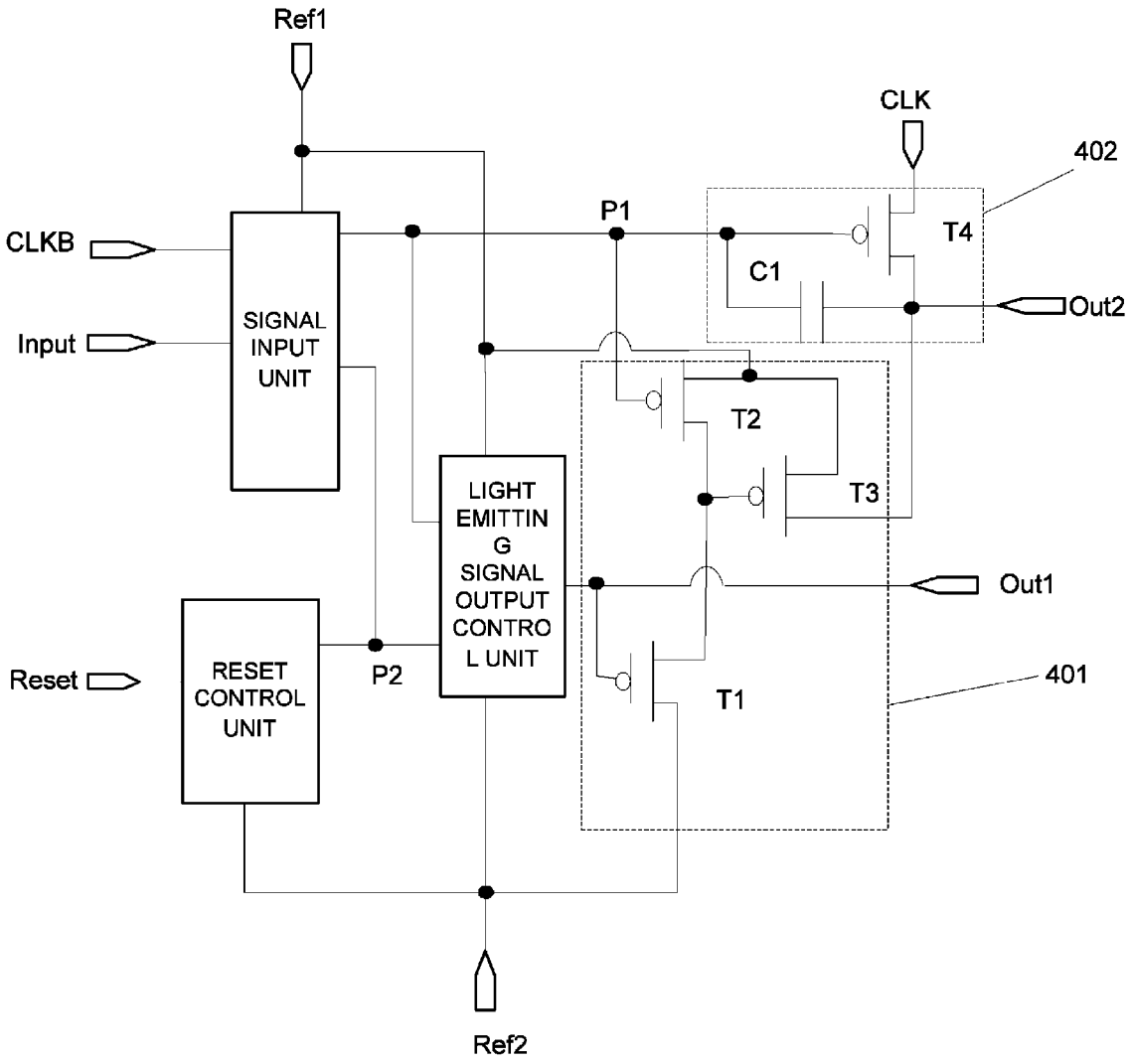
FIG. 3A and FIG. 3B are detailed structural diagrams showing scanning signal output control units in a shift register provided according to an embodiment of the present disclosure, respectively.
Figure 3B:
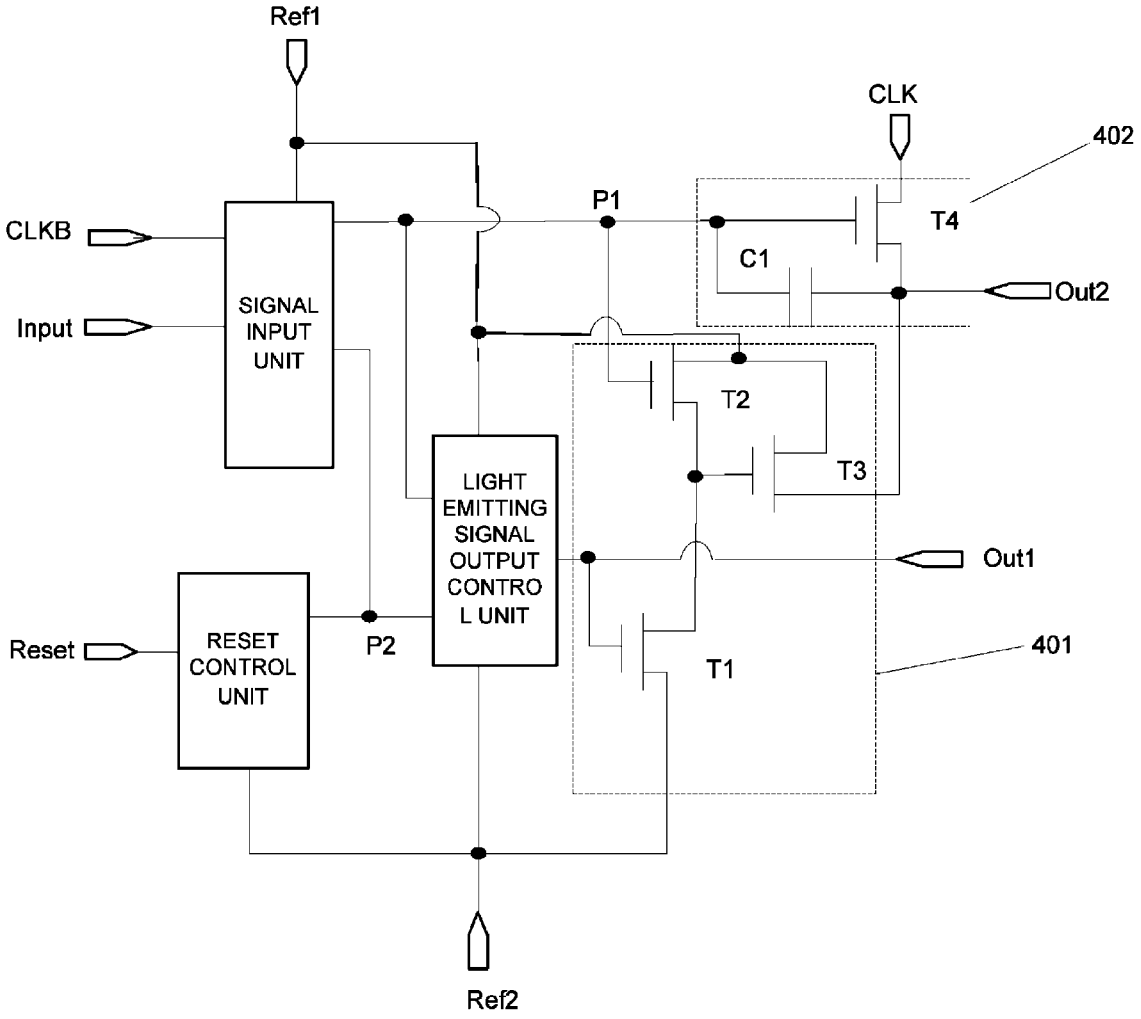

According to a specific implementation, in the above shift register provided by an embodiment of the present disclosure, the scanning signal output control unit, as shown in FIG. 3A and FIG. 3B, may comprise specifically: a first control module 401 and a second control module 402.

The first control module 401 has first input terminal connected to the first reference signal terminal Ref1, a second input terminal connected to the second reference signal terminal Ref2, a first control terminal connected to the first node P1, a second control terminal connected to the light emitting signal output terminal Out1, and an output terminal connected to the scanning signal output terminal Out2. The first control module 401 is used for conductively connecting the first reference signal terminal Ref1 to the scanning signal output terminal Out2 at the light emitting signal output phase.

The second control module 402 has an input terminal connected to the second clock signal terminal CLK, a control terminal connected to the first node P1, and an output terminal connected to the scanning signal output terminal Out2. The second control module 402 is used for conductively connecting the second clock signal terminal CLK to the scanning signal output terminal Out2 at the charging phase and the scanning signal output phase, and used for causing the scanning signal output terminal Out2 to output a scanning signal at the scanning signal output phase.

According to a specific implementation, in the above shift register provided by an embodiment of the present disclosure, at the charging phase and the scanning signal output phase, the second control module 402 turns on under the control of the first node P1. The second control module 402, which is on, conductively connects the second clock signal terminal CLK to the scanning signal output terminal Out2, such that the scanning signal output terminal Out2 outputs the clock signals of the second clock signal terminal CLK synchronously. A square wave signal is input into the second clock signal terminal CLK, such that the scanning signal output terminal Out2 outputs a scanning signal at the scanning signal output phase, and the scanning signal output terminal Out2 outputs a signal that has an opposite polarity to the scanning signal at the charging phase. At the light emitting signal output phase, the first control module 401 turns on under the control of the first node P1 and the light emitting signal output terminal Out1. The first control module 401, which is on, conductively connects the first reference signal terminal Ref1 to the scanning signal output terminal Out2. Since the signal input by the first reference signal Ref1 has a polarity opposite to that of the scanning signal, the scanning signal output terminal Out2 outputs a signal that has an opposite polarity to the scanning signal at the light emitting signal output phase.

According to a specific implementation, in the above shift register provided by an embodiment of the present disclosure, as shown in FIG. 3A and FIG. 3B, the first control module 401 may comprise specifically: a first switching transistor T1, a second switching transistor T2, and a third switching transistor T3.

The first switching transistor T1 has a gate connected to the light emitting signal output terminal Out1, a source connected to a drain of the second switching transistor T2, and a drain connected to the second reference signal terminal Ref2.

The second switching transistor T2 has a gate connected the first node P1, a source connected to the first reference signal terminal Ref1, and a drain connected to the source of the first switching transistor T1.

The third switching transistor T3 has a gate connected to the source of the first switching transistor T1 and the drain of the second switching transistor T2, respectively, a source connected to the first reference signal terminal Ref1, and a drain connected to the scanning signal output terminal Out2.

According to a specific implementation, the first switching transistor T1, the second switching transistor T2, and the third switching transistor T3 may all be P-type transistors (as shown in FIG. 3A) or N-type transistors (as shown in FIG. 3B) at the same time, and the present disclosure is not limited thereto. At the light emitting signal output phase, the first switching transistor T1 and the third switching transistor T3 are in an on state, and the second switching transistor T2 is in an off state. The third switching transistor T3 that is on conductively connects the first reference signal terminal Ref1 to the scanning signal output terminal Out2. When the first switching transistor T1, the second switching transistor T2, and the third switching transistor T3 are P-type transistors, the first reference signal terminal Ref1 inputs a high level signal, and all transistors in the display region of its corresponding display panel should be P-type transistors. Therefore, the scanning signal output terminal Out2 outputs a high level signal that has an opposite polarity to the scanning signal. When the first switching transistor T1, the second switching transistor T2, and the third switching transistor T3 are N-type transistors, the first reference signal terminal Ref1 inputs a low level signal, and all transistors in the display region of its corresponding display panel should be N-type transistors. Therefore, the scanning signal output terminal Out2 outputs a low level signal that has an opposite polarity to the scanning signal.

According to a specific implementation, in the above shift register provided by an embodiment of the present disclosure, as shown in FIG. 3A and FIG. 3B, the second control module 402 may comprise specifically: a fourth switching transistor T4 and a first capacitor C1.

The fourth switching transistor T4 has a gate connected to the first node P1, a source connected to the second clock signal terminal CLK, and a drain connected to the scanning signal output terminal Out2.

The first capacitor C1 is connected between the first node P1 and the scanning signal output terminal Out2.

According to a specific implementation, the fourth switching transistor T4 may be a P-type transistor (as shown in FIG. 3A) or an N-type transistor (as shown in FIG. 3B), and the present disclosure is not limited thereto. At the charging phase and the scanning signal output phase, the fourth switching transistor T4 is in an on state. The fourth switching transistor T4 that is on conductively connects the second clock signal terminal CLK to the scanning signal output terminal Out2, such that the scanning signal output terminal Out2 outputs the clock signals of the second clock signal terminal CLK synchronously. Further, at the scanning signal output phase, the clock signal from the second clock signal terminal CLK should be the scanning signals. When the fourth thin film transistor T4 is a P-type transistor, all transistors in the display region of its corresponding display panel should be P-type transistors, and the scanning signal output terminal Out2 outputs a low level scanning signal at the scanning signal output phase. When the fourth thin film transistor T4 is an N-type transistor, all transistors in the display region of its corresponding display panel should be N-type transistors, and the scanning signal output terminal Out2 outputs a high level scanning signal at the scanning signal output phase.

Figure 4A:
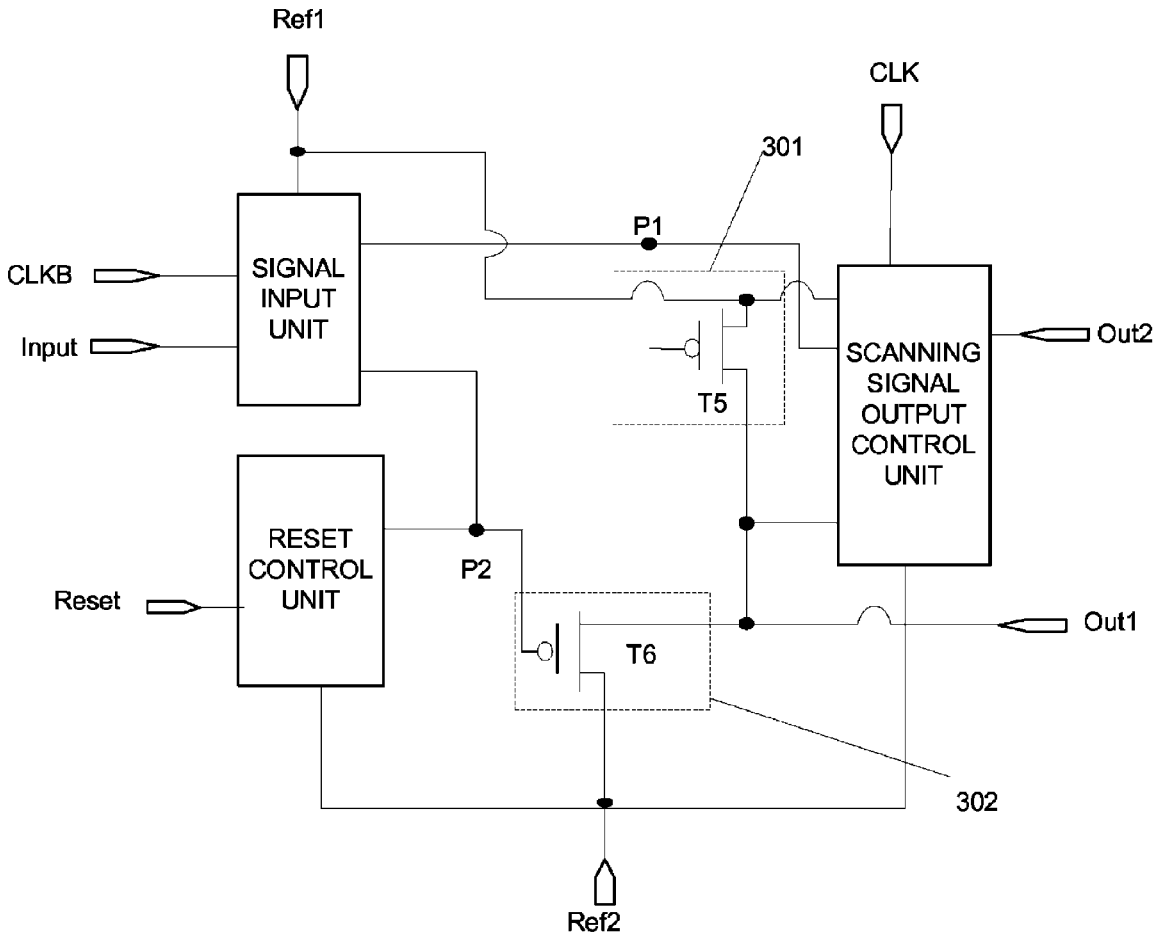
FIG. 4A and FIG. 4B are detailed structural diagrams showing light emitting signal output control units in a shift register provided according to an embodiment of the present disclosure, respectively.
Figure 4B:
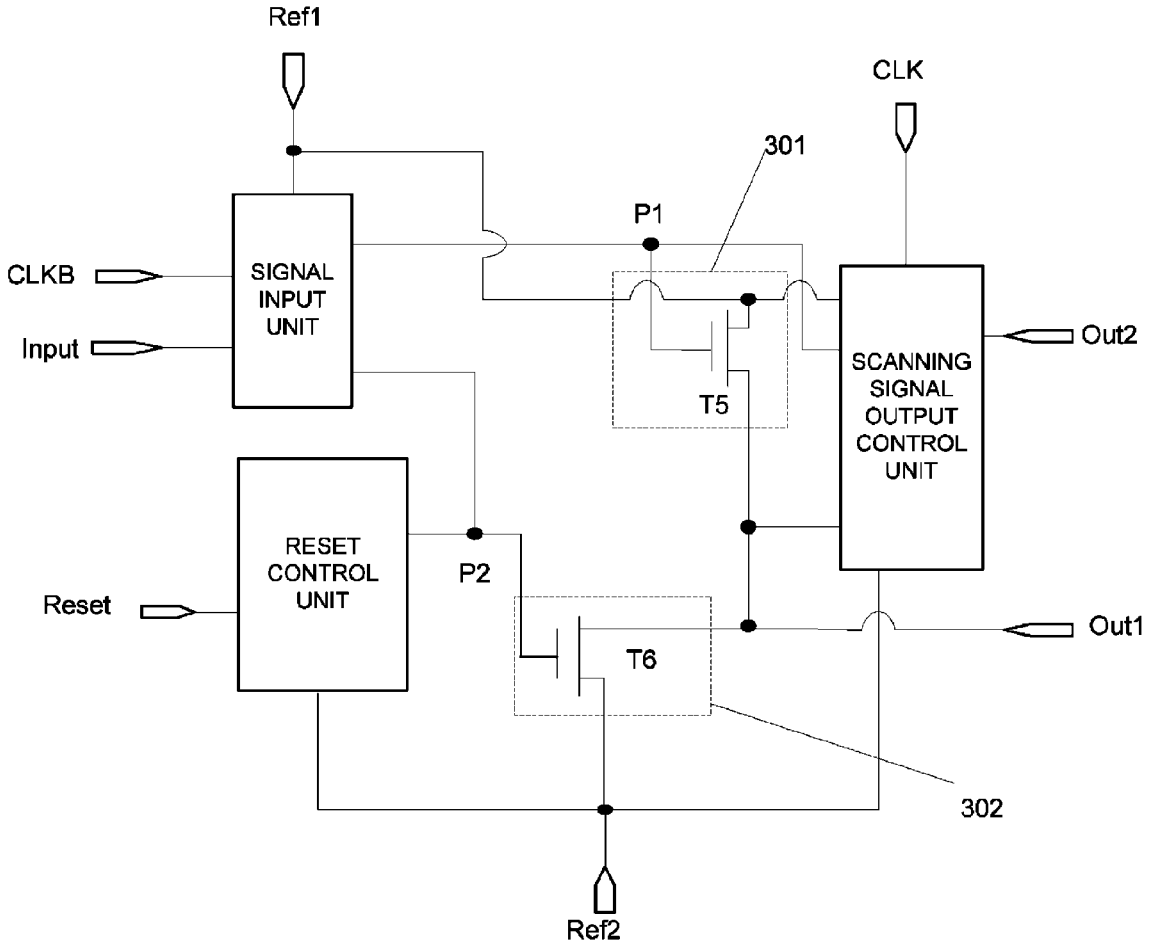

According to a specific implementation, in the above shift register provided by an embodiment of the present disclosure, the light emitting signal output control unit, as shown in FIG. 4A and FIG. 4B, may comprise specifically: a third control module 301 and a fourth control module 401.

The third control module 301 has an input terminal connected to the first reference signal terminal Ref1, a control terminal connected to the first node P1, and an output terminal connected to the light emitting signal output terminal Out1. The third control module 301 is used for conductively connecting the first reference signal terminal Ref1 to the light emitting signal output terminal Out1 at the charging phase and the scanning signal output phase.

The fourth control module 302 has an input terminal connected to the second reference signal terminal Ref2, a control terminal connected to the second node P2, and an output terminal connected to the light emitting signal output terminal Out1. The fourth control module 302 is used for conductively connecting the second reference signal terminal Ref2 and the light emitting signal output terminal Out1 at the light emitting signal output phase, such that the light emitting signal output terminal Out1 outputs a light emitting signal.

According to a specific implementation, in the above shift register provided by an embodiment of the present disclosure, at the charging phase and the scanning signal output phase, the third control module 301 turns on under the control of the first node P1. The third control module 301 that is on conductively connects the first reference signal terminal Ref1 to the light emitting signal output terminal Out1. Since the signal input by the first reference signal terminal Ref1 has a polarity opposite to that of the light emitting signal, the light emitting signal output terminal Out1 outputs a signal that has an opposite polarity to the light emitting signal at the charging phase and the scanning signal output phase. At the light emitting signal output phase, the fourth control module 302 turns on under the control of the second node P2. The fourth control module 302 that is on conductively connects the second reference signal terminal Ref2 to the light emitting signal output terminal Out1. Since the signal input by the second reference signal terminal Ref2 has a polarity same as that of the light emitting signal, the light emitting signal output terminal Out1 outputs a light emitting signal at the light emitting signal output phase.

According to a specific implementation, in the above shift register provided by an embodiment of the present disclosure, as shown in FIG. 4A and FIG. 4B, the third control module 301 may comprise specifically: a fifth switching transistor T5.

The fifth switching transistor T5 has a gate connected to the first node P1, a source connected to the first reference signal terminal Ref1, and a drain connected to the light emitting signal output terminal Out1.

According to a specific implementation, the fifth switching transistor T5 may be a P-type transistor (as shown in FIG. 4A) or an N-type transistor (as shown in FIG. 4B), and the present disclosure is not limited thereto. At the charging phase and the scanning signal output phase, the fifth switching transistor T5 is in an on state. The fifth switching transistor T5 that is on conductively connects the light emitting signal output terminal Out1 to first reference signal terminal Ref1. When the fifth thin film transistor T5 is a P-type transistor, the first reference signal terminal Ref1 inputs a high level signal, and all transistors in the display region of its corresponding display panel should be P-type transistors. The light emitting signal output terminal Out1 outputs a high level light emitting signal at the charging phase and the scanning signal output phase. When the fifth thin film transistor T5 is an N-type transistor, the first reference signal terminal Ref1 inputs a low level signal, and all transistors in the display region of its corresponding display panel should be N-type transistors. The light emitting signal output terminal Out1 outputs a low level light emitting signal at the charging phase and the scanning signal output phase.

According to a specific implementation, in the above shift register provided by an embodiment of the present disclosure, as shown in FIG. 4A and FIG. 4B, the fourth control module 302 may comprise specifically: a sixth switching transistor T6.

The sixth switching transistor T6 has a gate connected to the second node P2, a source connected to the light emitting signal output terminal Out1, and a drain connected to the second reference signal terminal Ref2.

According to a specific implementation, the sixth switching transistor T6 may be a P-type transistor (as shown in FIG. 4A) or an N-type transistor (as shown in FIG. 4B), and the present disclosure is not limited thereto. At the light emitting signal output phase, the sixth switching transistor T6 is in an on state. The sixth switching transistor T6 that is on conductively connects the light emitting signal output terminal Out1 and second reference signal terminal Ref2. When the sixth thin film transistor T6 is a P-type transistor, the second reference signal terminal Ref2 inputs a low level signal, and all transistors in the display region of its corresponding display panel should be P-type transistors. The light emitting signal output terminal Out1 outputs a low level light emitting signal at the light emitting signal output phase. When the sixth thin film transistor T6 is an N-type transistor, the second reference signal terminal Ref2 inputs a high level signal, and all transistors in the display region of its corresponding display panel should be N-type transistors. The light emitting signal output terminal Out1 outputs a high level light emitting signal at the light emitting signal output phase.

Figure 5A:
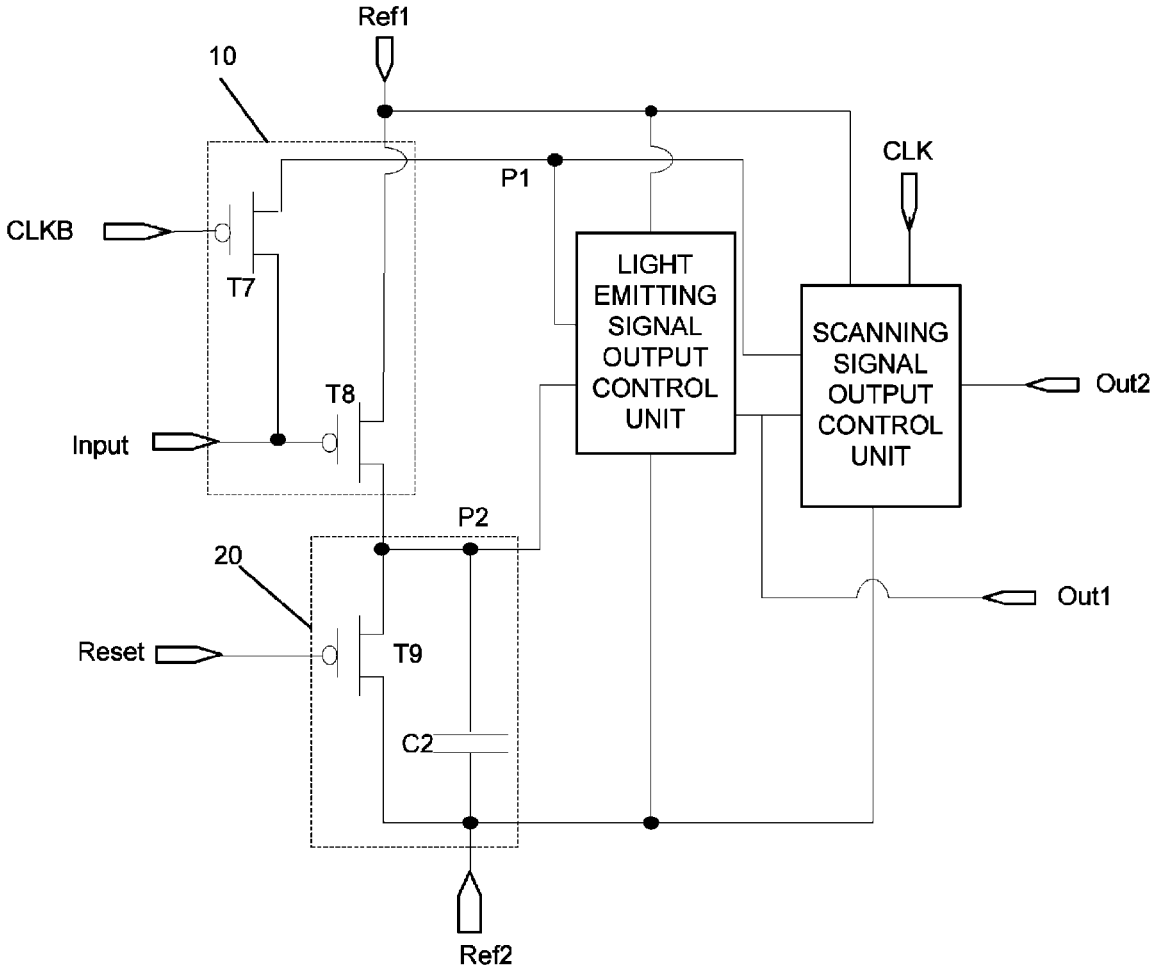
FIG. 5A and FIG. 5B are detailed structural diagrams showing signal input units and reset control units in a shift register provided according to an embodiment of the present disclosure, respectively.
Figure 5B:
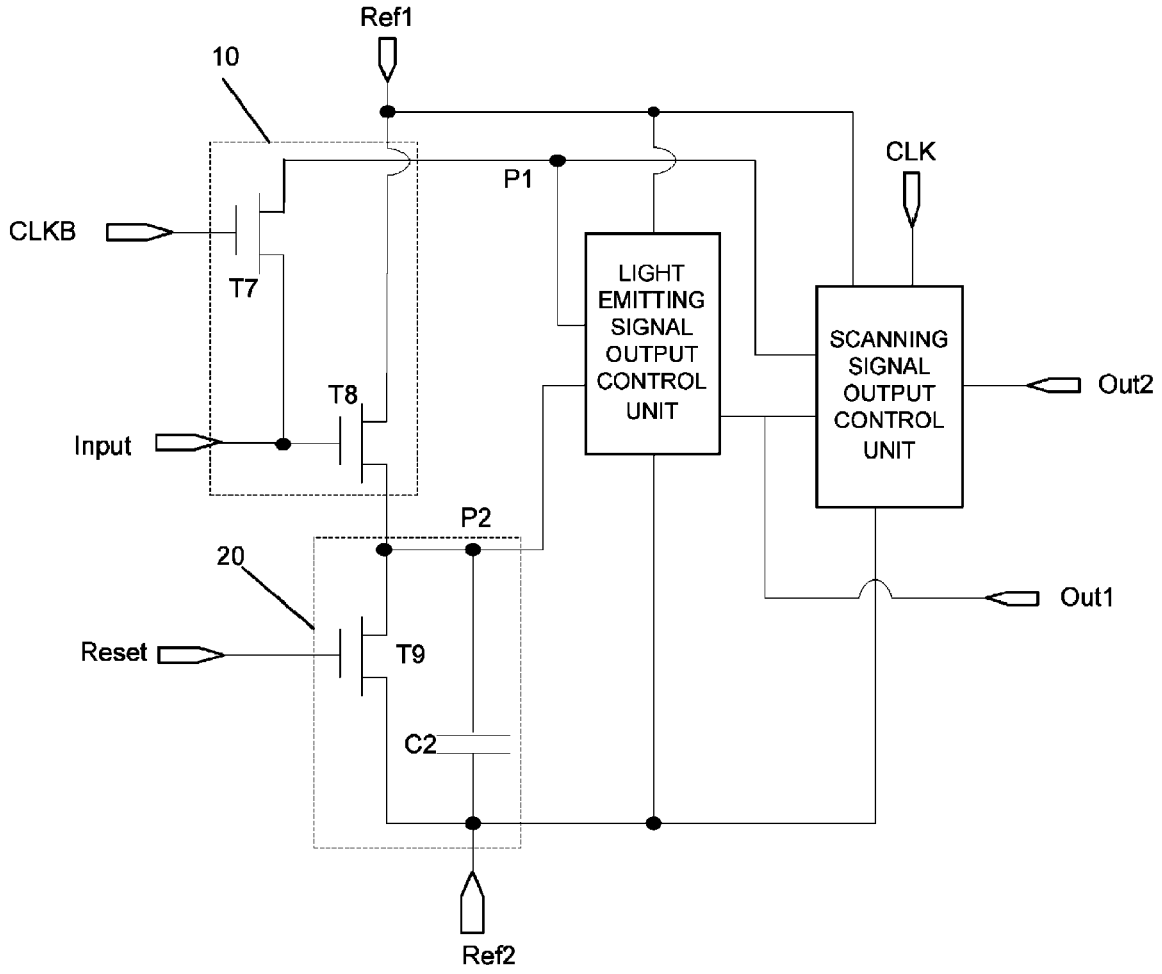

According to a specific implementation, in the above shift register provided by an embodiment of the present disclosure, as shown in FIG. 5A and FIG. 5B, the signal input unit 10 may comprise specifically: a seventh switching transistor T7 and an eighth switching transistor T8.

The seventh switching transistor T7 has a gate connected to the first clock signal terminal CLKB, a source connected to the first node P1, and a drain connected to the signal input terminal "Input".

The eighth switching transistor T8 has a gate connected to the signal input terminal "Input", a source connected to the first reference signal terminal Ref1, and a drain connected to the second node P2.

According to a specific implementation, both the seventh switching transistor T7 and the eighth switching transistor T8 may be P-type transistors (as shown in FIG. 5A) or N-type transistors (as shown in FIG. 5B) at the same time, and the present disclosure is not limited thereto. When the seventh switching transistor T7 is a P-type transistor and the first clock signal terminal CLKB inputs a low level signal, the seventh switching transistor T7 is in an on state; and when the seventh switching transistor T7 is an N-type transistor and the first clock signal terminal CLKB inputs a high level signal, the seventh switching transistor T7 is in an on state. The seventh switching transistor T7 that is on conductively connects the first node P1 to the signal input terminal "Input", such that the potential of the first node P1 is same as the potential of the signal input terminal "Input". When the eighth switching transistor T8 is a P-type transistor, and the first reference signal terminal Ref1 inputs a high level signal, and the single input terminal "Input" inputs a low level signal, the eighth switching transistor T8 turns on. The eighth switching transistor T8 that is on conductively connects the first reference signal terminal Ref1 to the second node P2, such that the second node P2 is in a state of high-level. When the eighth switching transistor T8 is an N-type transistor, and the first reference signal terminal Ref1 inputs a low level signal, and the single input terminal "Input" inputs a high level signal, the eighth switching transistor T8 turns on. The eighth switching transistor T8 that is on conductively connects the first reference signal terminal Ref1 to the second node P2, such that the second node P2 is in a state of low-level.

According to a specific implementation, in the above shift register provided by an embodiment of the present disclosure, as shown in FIG. 5A and FIG. 5B, the reset control unit 20 may comprise specifically: a ninth switching transistor T9 and a second capacitor C2.

The ninth switching transistor T9 has a gate connected to the reset signal terminal Reset, a source connected to the second node P2, and a drain connected to the second reference signal terminal Ref2.

The second capacitor C2 is connected between the second node P2 and the second reference signal terminal Ref2.

According to a specific implementation, the ninth switching transistor T9 may be a P-type transistor (as shown in FIG. 5A) or an N-type transistor (as shown in FIG. 5B), and the present disclosure is not limited thereto. When the ninth switching transistor T9 is a P-type transistor, and the second reference signal terminal Ref2 inputs a low level signal, and the reset signal terminal Reset inputs a low level signal, the ninth switching transistor T9 turns on. The ninth switching transistor T9 that is on conductively connects the second reference signal terminal Ref2 to the second node P2, such that the second node P2 is in a state of low-level. When the ninth switching transistor T9 is an N-type transistor, and the second reference signal terminal Ref2 inputs a high level signal, and the reset signal terminal Reset inputs a high level signal, the ninth switching transistor T9 is in an on state. The ninth switching transistor T9 that is on conductively connects the second reference signal terminal Ref2 to the second node P2, such that the second node P2 is in a state of high-level.

Figure 6:
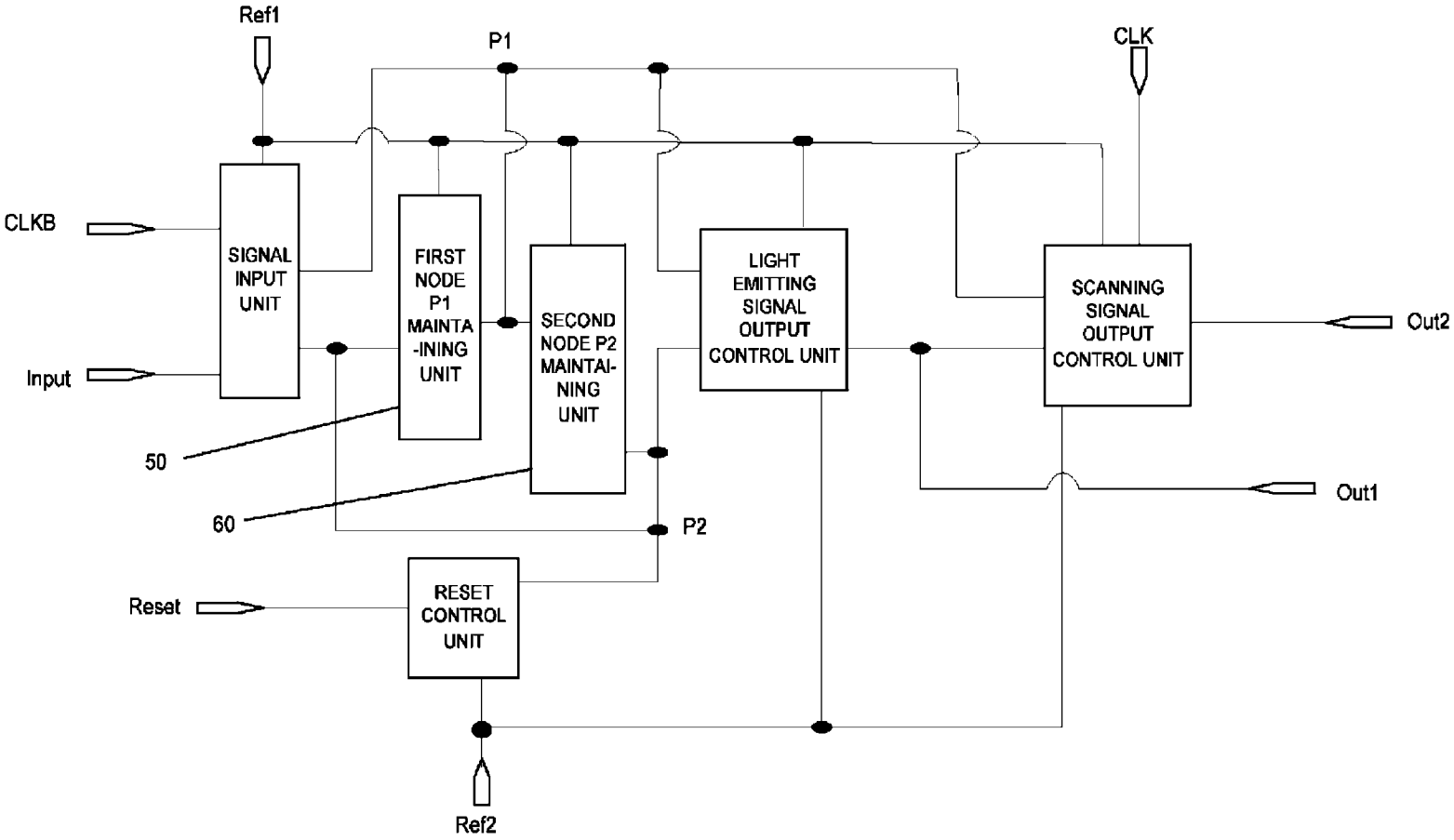
FIG. 6 is a second structural diagram showing a shift register provided according to an embodiment of the present disclosure.

According to a specific implementation, the above shift register provided by an embodiment of the present disclosure, as shown in FIG. 6, further comprises: a first node P1 maintaining unit 50.

The first node P1 maintaining unit 50 has an input terminal connected to the first reference signal terminal Ref1, a control terminal connected to the second node P2, and an output terminal connected to the first node P1. The first node P1 maintaining unit 50 is used for maintaining the potential of the first node P1 under the control of the second node P2 at the light emitting signal output phase.

According to a specific implementation, in the above shift register provided by an embodiment of the present disclosure, at the light emitting signal output phase, the first node P1 maintaining unit 50 turns on under the control of the second node P2. The first node P1 maintaining unit 50 that is on conductively connects the first reference signal terminal Ref1 to the first node P1, so as to further maintain the potential of the first node P1 and reduce the noise output from the first node P1.

Figure 7A:
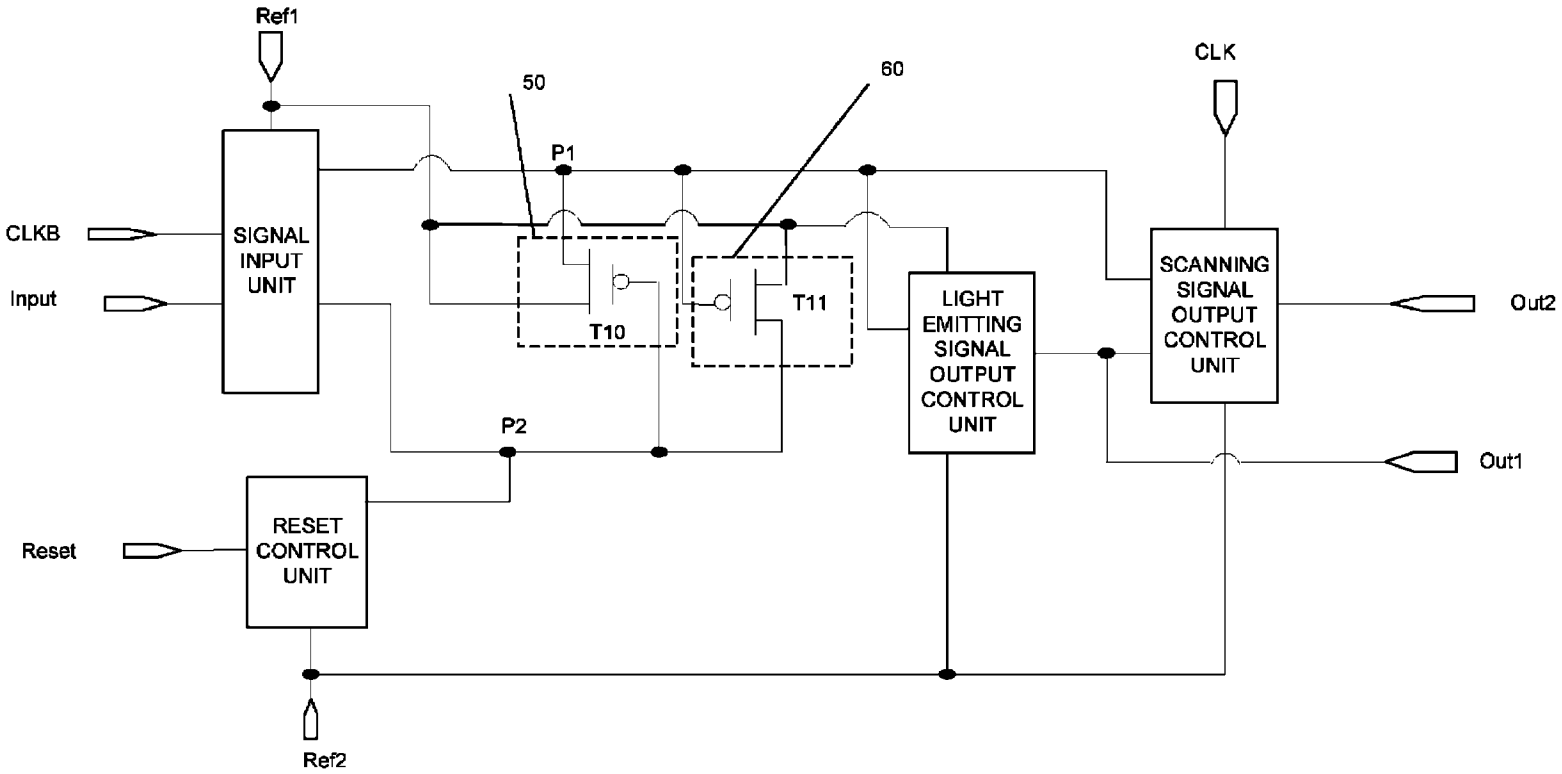
FIG. 7A and FIG. 7B are detailed structural diagrams showing first node maintaining units and second node maintaining units in a shift register provided according to an embodiment of the present disclosure, respectively.
Figure 7B:
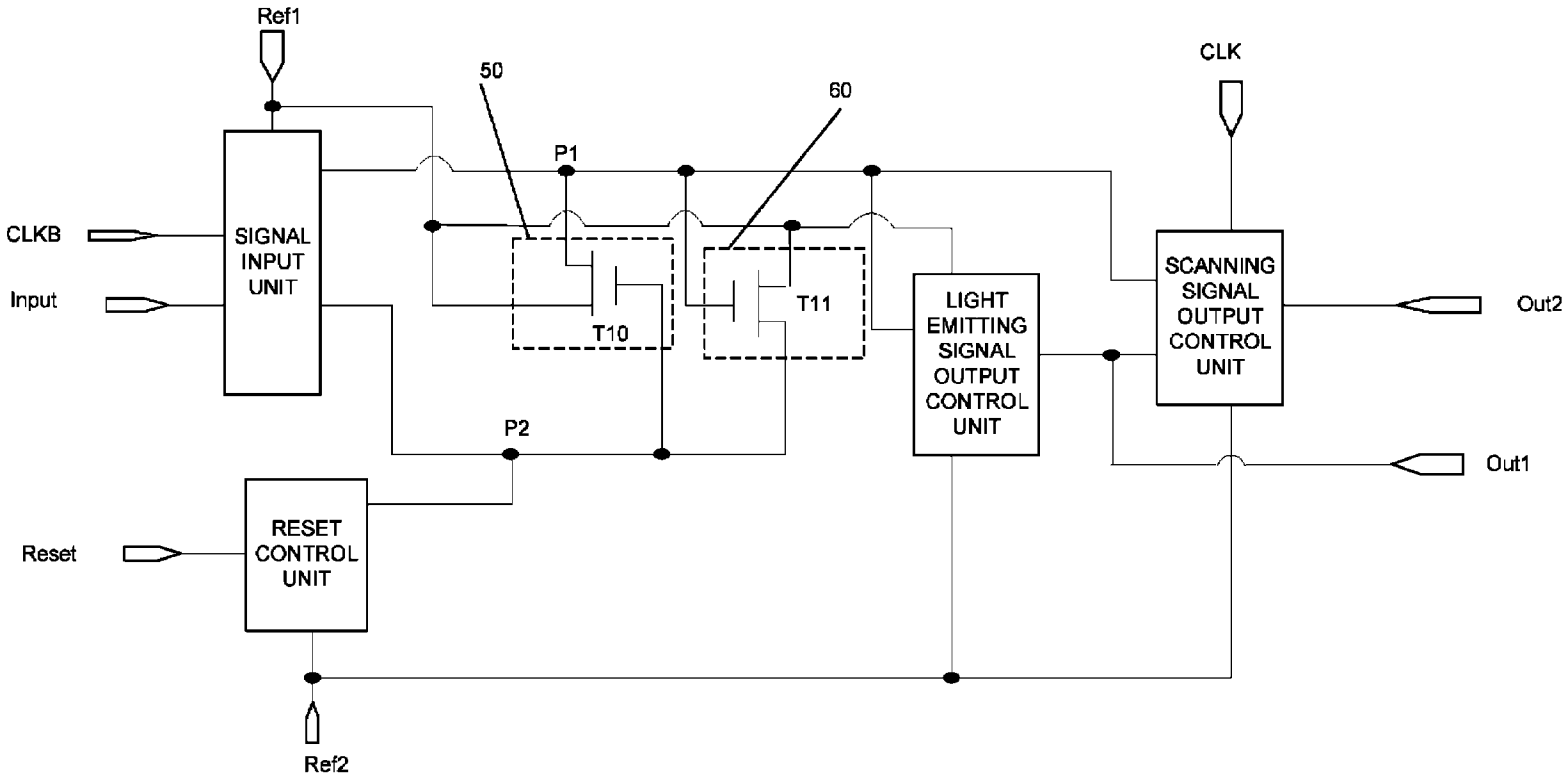

According to a specific implementation, in the above shift register provided by an embodiment of the present disclosure, as shown in FIG. 7A and FIG. 7B, the first node P1 maintaining unit 50 may comprise specifically: a tenth switching transistor T10.

The tenth switching transistor T10 has a gate connected to the second node P2, a source connected to the first reference signal terminal Ref1, and a drain connected to the first node P1.

According to a specific implementation, the tenth switching transistor T10 may be a P-type transistor (as shown in FIG. 7A) or an N-type transistor (as shown in FIG. 7B), and the present disclosure is not limited thereto. When the tenth switching transistor T10 is a P-type transistor, and the first reference signal terminal Ref1 inputs a high level signal, and the second node P2 is in a state of low-level, the tenth switching transistor T10 turns on. The tenth switching transistor T10 that is on conductively connects the first reference signal terminal Ref1 to the first node P1, such that the first node P1 is maintained in a state of high-level. When the tenth switching transistor T10 is an N-type transistor, and the first reference signal terminal Ref1 inputs a low level signal, and the second node P2 is in a state of high-level, the tenth switching transistor T10 turns on. The tenth switching transistor T10 that is on conductively connects the first reference signal terminal Ref1 to the first node P1, such that the first node P1 is maintained in a state of low-level.

According to a specific implementation, the above shift register provided by an embodiment of the present disclosure, as shown in FIG. 6, further comprises: a second node P2 maintaining unit 60.

The second node P2 maintaining unit 60 has an input terminal connected to the first reference signal terminal Ref1, a control terminal connected to the first node P1, and an output terminal connected to the second node P2. The second node P2 maintaining unit 60 is used for maintaining the potential of the second node P2 under the control of the first node P1 at the charging phase and the scanning signal output phase.

According to a specific implementation, in the above shift register provided by an embodiment of the present disclosure, at the charging phase and the scanning signal output phase, the second node P2 maintaining unit 60 turns on under the control of the first node P1. The second node P2 maintaining unit 60 that is on conductively connects the first reference signal terminal Ref1 to the second node P2, so as to further maintain the potential of the second node P2 and reduce the noise output from the second node P2.

According to a specific implementation, in the above shift register provided by an embodiment of the present disclosure, as shown in FIG. 7A and FIG. 7B, the second node P2 maintaining unit 60 may comprise specifically: a eleventh switching transistor T11.

The eleventh switching transistor T11 has a gate connected to the first node P1, a source connected to the first reference signal terminal Ref1, and a drain connected to the second node P2.

According to a specific implementation, the eleventh switching transistor T11 may be a P-type transistor (as shown in FIG. 7A) or an N-type transistor (as shown in FIG. 7B), and the present disclosure is not limited thereto. When the eleventh switching transistor T11 is a P-type transistor, and the first reference signal terminal Ref1 inputs a high level signal, and the first node P1 is in a state of low-level, the eleventh switching transistor T11 turns on. The eleventh switching transistor T11 that is on conductively connects the first reference signal terminal Ref1 to the second node P2, such that the second node P2 is maintained in a state of high-level. When the eleventh switching transistor T11 is an N-type transistor, and the first reference signal terminal Ref1 inputs a low level signal, and the first node P1 is in a state of high-level, the eleventh switching transistor T11 turns on. The eleventh switching transistor T11 that is on conductively connects the first reference signal terminal Ref1 to the second node P2, such that the second node P2 is maintained in a state of low-level.

It should be noted that the switching transistors mentioned in the above embodiments of the present disclosure may be Thin Film Transistors (TFT) or Metal Oxide Semiconductor Field Effect Transistor (MOSFET), and the present disclosure is not limited thereto. In specific implementations, sources and drains of these transistors may be swapped and no specific definition thereof is given. In describing specific embodiments, Thin Film Transistors are used as examples for illustration.

Further, all the switching transistors mentioned in the above shift register provided according to an embodiment of the present disclosure may have either a same P-type transistor design or a same N-type transistor design. In this way, the process for manufacturing the circuit of the shift register may be simplified. When all the switching transistors mentioned in the above shift register provided according to an embodiment of the present disclosure are P-type transistors, the first reference signal terminal Ref1 inputs a high level signal, and the second reference signal terminal Ref2 inputs a low level signal; and when they are all N-type transistors, the first reference signal terminal Ref1 inputs a low level signal, and the second reference signal terminal Ref2 inputs a high level signal.

A detailed description of the operation flow of the shift register provided according to an embodiment of the present disclosure will be given below with reference to the structure and timing of the shift register provided according to an embodiment of the present disclosure. In Embodiment 1, all switching transistors of the shift register are P-type transistors. In Embodiment 2, all switching transistors of the shift register are N-type transistors.

Embodiment 1

Figure 8A:
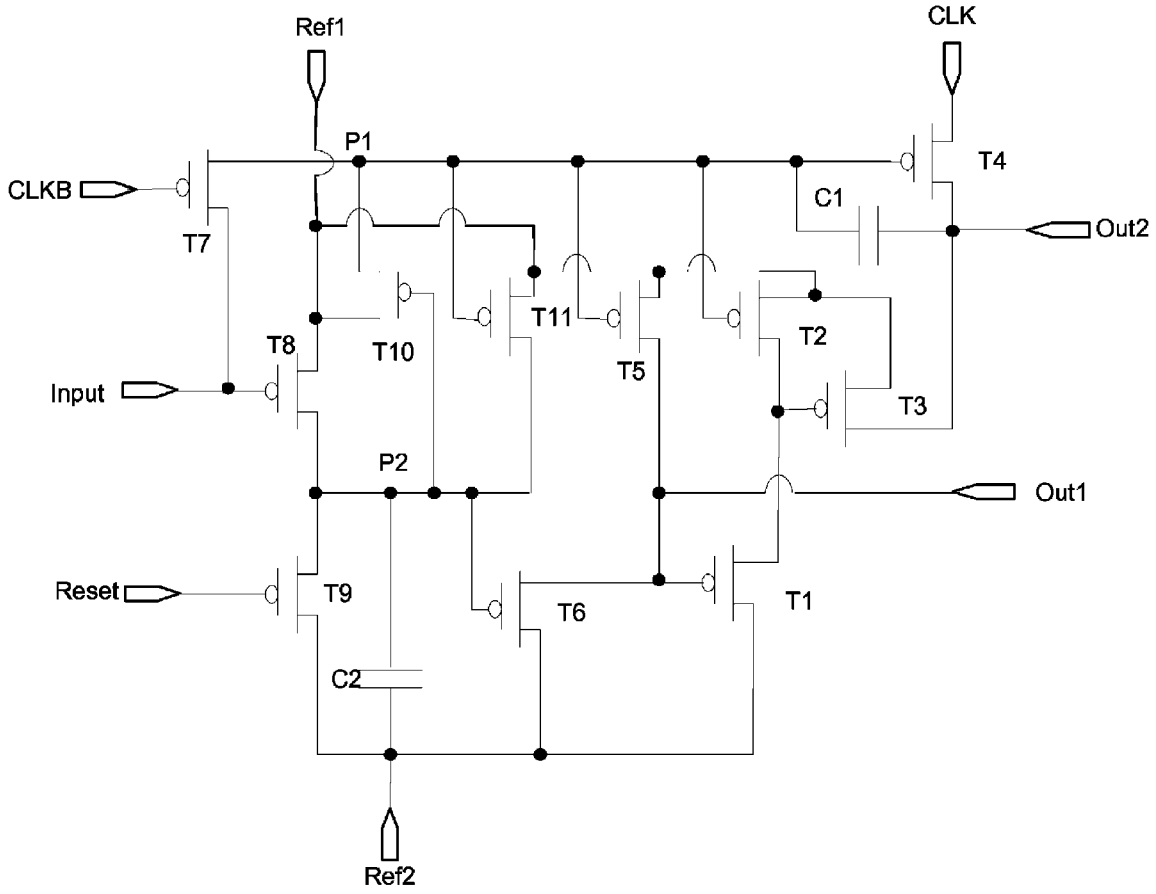
FIG. 8A is a detailed structural diagram of Embodiment 1 provided according to an embodiment of the present disclosure.
Figure 8B:
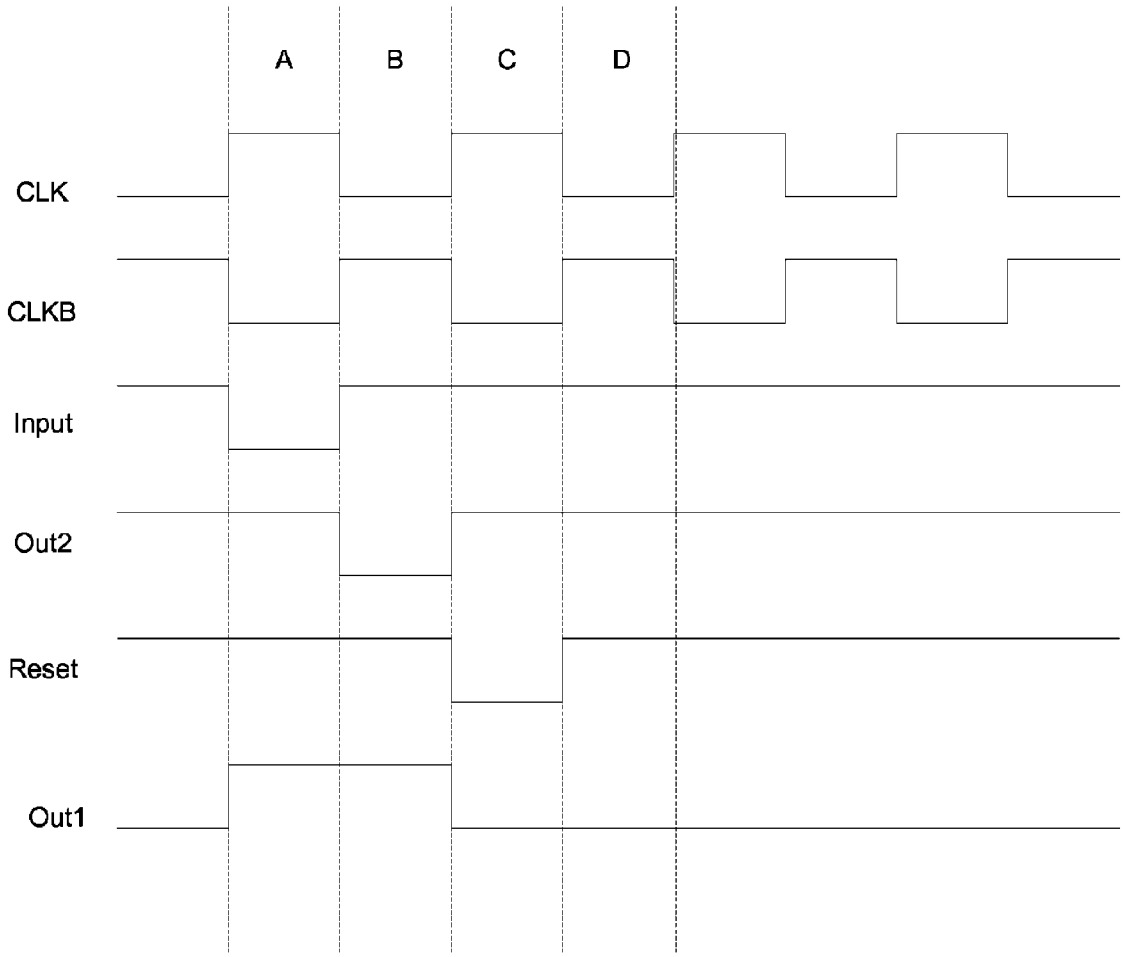
FIG. 8B is a timing diagram of Embodiment 1 provided according to an embodiment of the present disclosure.

A description of the operation flow of the shift register provided according to an embodiment of the present disclosure will be given with reference to the shift register shown in FIG. 8A and the input/output timing diagram for FIG. 8A shown in FIG. 8B. To be specific, four phases, A-D, shown in the input/output timing diagram in FIG. 8B are selected. In the following descriptions, "1" represents a high level signal, and "0" represents a low level signal.

At the phase A, Input=0, CLKB=0, CLK=1, Reset=1, and Ref1=1. Since Reset=1, the ninth switching transistor T9 turns off. Since Input=0, the eighth switching transistor T8 turns on, and Ref1 is conductively connected to the second node P2 such that the second node P2 is in a state of high-level, which in turns causes the tenth switching transistor T10 and the sixth switching transistor T6 to turn off. The sixth switching transistor T6 that is off causes the first switching transistor T1 to turn off. Meanwhile, since CLKB=0, the seventh switching transistor T7 turns on. The signal input terminal "Input" charges the first capacitor C1 via the seventh switching transistor T7 that is on, while the seventh switching transistor T7 that is on conductively connects the first node P1 to the signal input terminal "Input". Therefore, the first node P1 is in a state of low-level, which in turns causes the eleventh switching transistor T11, the fifth switching transistor T5, the fourth switching transistor T4, and the second switching transistor T2 to turn on. The second switching transistor T2 that is on causes the third switching transistor T3 to turn off. The fourth switching transistor T4 that is on conductively connects the second clock signal terminal CLK to the scanning signal output terminal Out2, such that the scanning signal output terminal Out2 outputs a high level signal. The fifth switching transistor T5 that is on conductively connects the first reference signal terminal Ref1 to the light emitting signal output terminal Out1, such that the light emitting signal output terminal Out1 outputs a high level signal. The phase A is a charging phase for the first capacitor C1.

At the phase B, Input=1, CLKB=1, CLK=0, Reset=1, and Ref1=1. Since Input=1, CLKB=1, and Reset=1, the seventh switching transistor T7, the eight switching transistor T8, and the ninth switching transistor T9 all turn off, and the first node P1 is maintained in a state of low-level. Meanwhile, since the ninth switching transistor T9 turns off, the second capacitor C2 has no discharge path, and therefore the second node P2 is still in a state of high-level. The sixth switching transistor T6 and the tenth switching transistor T10 turn off. The sixth switching transistor T6 that is off causes the first switching transistor T1 to turn off. The fact that the first node P1 is in a state of low-level causes the eleventh switching transistor T11, the fifth switching transistor T5, the fourth switching transistor T4, and the second switching transistor T2 to turn on. The second switching transistor T2 that is on causes the third switching transistor T3 to turn off. The fourth switching transistor T4 that is on conductively connects the scanning signal output terminal Out2 to the second clock signal terminal CLK, such that the scanning signal output terminal Out2 outputs a low level signal. The fifth switching transistor T5 that is on conductively connects the first reference signal terminal Ref1 to the light emitting signal output terminal Out1, such that the light emitting signal output terminal Out1 outputs a high level signal. The phase B is a scanning signal output phase.

At the phase C, Input=1, CLKB=0, CLK=1, Reset=0, Ref1=1, and Ref2=0. Since Input=1, the eighth switching transistor T8 turns off. Since CLKB=0, the seventh switching transistor T7 turns on. The seventh switching transistor T7 that is on conductively connects the first node P1 to the signal input terminal "Input", such that the first node P1 is in a state of high-level. Therefore, the eleventh switching transistor T11, the fifth switching transistor T5, the fourth switching transistor T4, and the second switching transistor T2 turn off. Since Reset=0, the ninth switching transistor T9 turns on. The ninth switching transistor T9 that is on conductively connects the second node P2 to the second reference signal terminal Ref2, such that the second node P2 is in a state of low-level, which in turns causes the sixth switching transistor T6 and the tenth switching transistor T10 to turn on. The sixth switching transistor T6 that is on causes the first switching transistor T1 to turn on. The first switching transistor T1 that is on causes the third switching transistor T3 to turn on. The third switching transistor T3 that is on conductively connects the first reference signal terminal Ref1 to the scanning signal output terminal Out2, such that the scanning signal output terminal Out2 outputs a high level signal. Meanwhile, the sixth switching transistor T6 that is on conductively connects the light emitting signal output terminal Out1 to the second reference signal terminal Ref2. Therefore, the light emitting signal output terminal Out1 outputs a low level signal. The phase C is a light emitting signal output phase.

At the phase D, Input=1, CLKB=1, CLK=0, Reset=1, Ref1=1, and Ref2=0. Since Input=1, CLKB=1, and Reset=1, the seventh switching transistor T7, the eight switching transistor T8, and the ninth switching transistor T9 all turn off. The second capacitor C2 has no discharge path, and therefore the second node P2 is still in a state of low-level. Since the first capacitor C1 has no discharge path either, and therefore the first node P1 is maintained in a state of high-level. The fact that the first node P1 is in a state of high-level causes the eleventh switching transistor T11, the fifth switching transistor T5, the fourth switching transistor T4, and the second switching transistor T2 to turn off. The fact that the second node P2 is in a state of low-level causes the sixth switching transistor T6 and the tenth switching transistor T10 to turn on. The sixth switching transistor T6 that is on causes the first switching transistor T1 to turn on. The first switching transistor T1 that is on causes the third switching transistor T3 to turn on. The third switching transistor T3 that is on conductively connects the first reference signal terminal Ref1 to the scanning signal output terminal Out2, such that the scanning signal output terminal Out2 outputs a high level signal. Meanwhile, the sixth switching transistor T6 that is on conductively connects the light emitting signal output terminal Out1 to the second reference signal terminal Ref2, such that the light emitting signal output terminal Out1 outputs a low level signal. The phase D is still a light emitting signal output phase.

No more description will be given here, and the next phase is still a light emitting signal output phase.

Embodiment 2

Figure 9A:
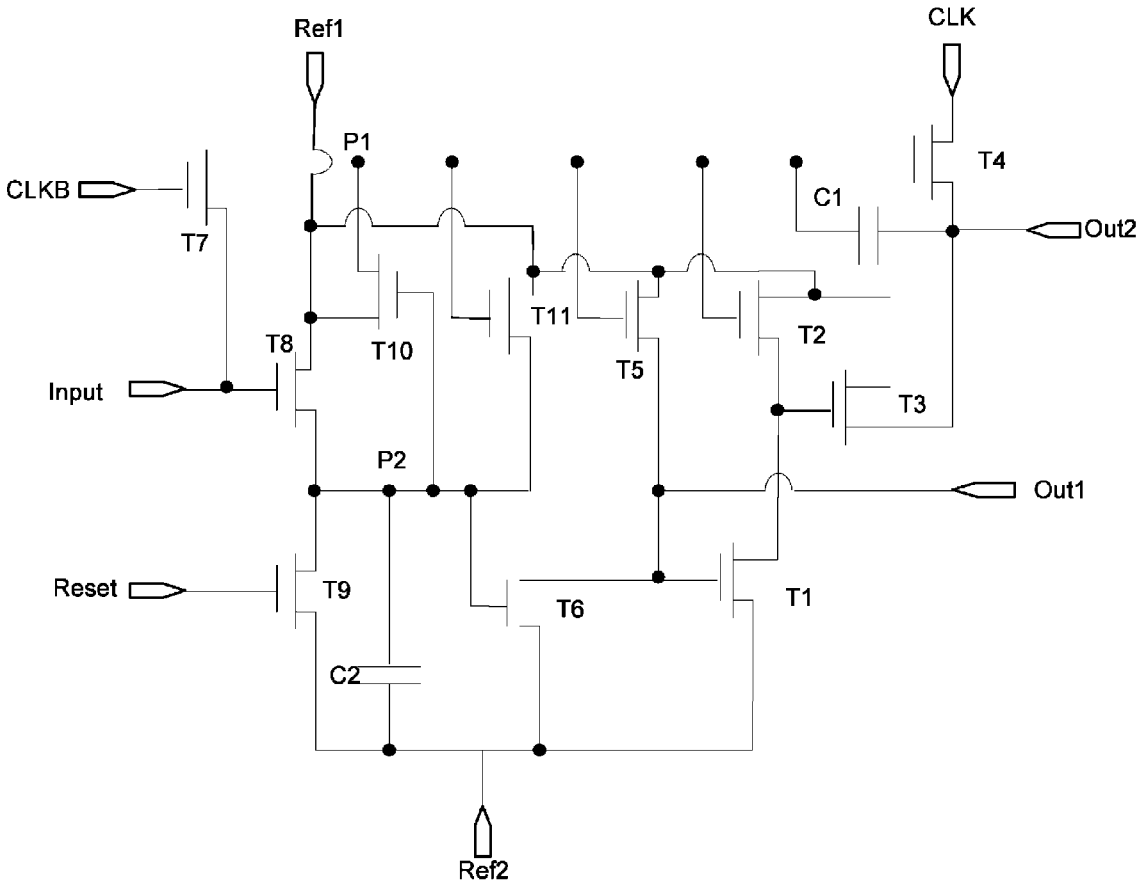
FIG. 9A is a detailed structural diagram of Embodiment 2 provided according to an embodiment of the present disclosure.
Figure 9B:
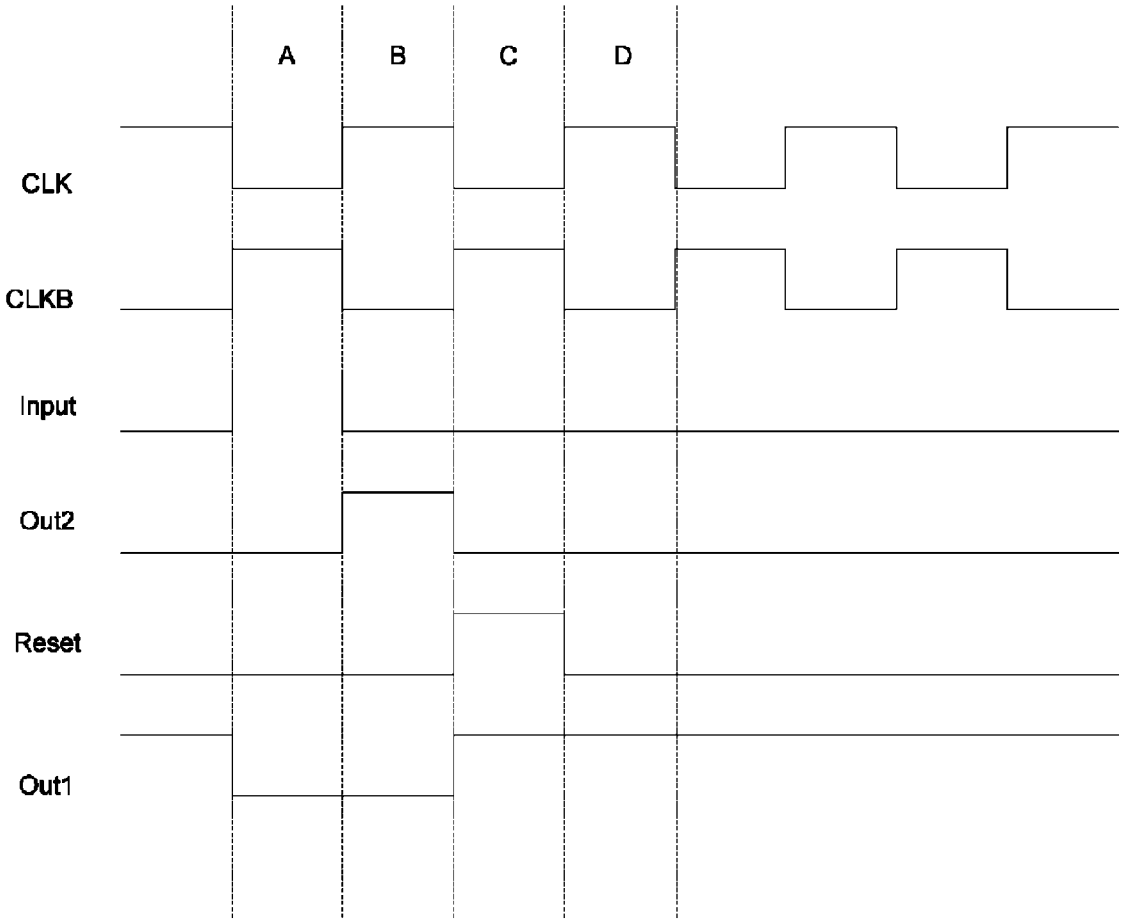
FIG. 9B is a timing diagram of Embodiment 2 provided according to an embodiment of the present disclosure.

A description of the operation flow of the shift register provided according to an embodiment of the present disclosure will be given with reference to the shift register shown in FIG. 9A and the input/output timing diagram for FIG. 9A shown in FIG. 9B. To be specific, four phases, A-D, shown in the input/output timing diagram shown in FIG. 9B are selected. In the following descriptions, "1" represents a high level signal, and "0" represents a low level signal.

At the phase A, Input=1, CLKB=1, CLK=0, Reset=0, and Ref1=0. Since Reset=0, the ninth switching transistor T9 turns off. Since Input=1, the eighth switching transistor T8 turns on, and Ref1 is conductively connected to the second node P2 such that the second node P2 is in a state of low-level, which in turns causes the tenth switching transistor T10 and the sixth switching transistor T6 to turn off. The sixth switching transistor T6 that is off causes the first switching transistor T1 to turn off. Meanwhile, since CLKB=1, the seventh switching transistor T7 turns on. The signal input terminal "Input" charges the first capacitor C1 via the seventh switching transistor T7 that is on, while the seventh switching transistor T7 that is on conductively connects the first node P1 to the signal input terminal "Input". Therefore, the first node P1 is in a state of high-level, which in turns causes the eleventh switching transistor T11, the fifth switching transistor T5, the fourth switching transistor T4, and the second switching transistor T2 to turn on. The second switching transistor T2 that is on causes the third switching transistor T3 to turn off. The fourth switching transistor T4 that is on conductively connects the second clock signal terminal CLK to the scanning signal output terminal Out2, such that the scanning signal output terminal Out2 outputs a low level signal. The fifth switching transistor T5 that is on conductively connects the first reference signal terminal Ref1 to the light emitting signal output terminal Out1, such that the light emitting signal output terminal Out1 outputs a low level signal. The phase A is a charging phase for the first capacitor C1.

At the phase B, Input=0, CLKB=0, CLK=1, Reset=0, and Ref1=0. Since Input=0, CLKB=0, and Reset=0, the seventh switching transistor T7, the eight switching transistor T8, and the ninth switching transistor T9 all turn off, and the first node P1 is maintained in a state of high-level. Meanwhile, since the ninth switching transistor T9 turns off, the second capacitor C2 has no discharge path, and therefore the second node P2 is still in a state of low-level. The sixth switching transistor T6 and the tenth switching transistor T10 turn off. The sixth switching transistor T6 that is off causes the first switching transistor T1 to turn off. The fact that the first node P1 is in a state of high-level causes the eleventh switching transistor T11, the fifth switching transistor T5, the fourth switching transistor T4, and the second switching transistor T2 to turn on. The second switching transistor T2 that is on causes the third switching transistor T3 to turn off. The fourth switching transistor T4 that is on conductively connects the scanning signal output terminal Out2 to the second clock signal terminal CLK, such that the scanning signal output terminal Out2 outputs a high level signal. The fifth switching transistor T5 that is on conductively connects the first reference signal terminal Ref1 to the light emitting signal output terminal Out1, such that the light emitting signal output terminal Out1 outputs a low level signal. The phase B is a scanning signal output phase.

At the phase C, Input=0, CLKB=1, CLK=0, Reset=1, Ref1=0, and Ref2=1. Since Input=0, the eighth switching transistor T8 turns off. Since CLKB=1, the seventh switching transistor T7 turns on. The seventh switching transistor T7 that is on conductively connects the first node P1 to the signal input terminal "Input", such that the first node P1 is in a state of low-level. Therefore, the eleventh switching transistor T11, the fifth switching transistor T5, the fourth switching transistor T4, and the second switching transistor T2 turn off. Since Reset=1, the ninth switching transistor T9 turns on. The ninth switching transistor T9 that is on conductively connects the second node P2 to the second reference signal terminal Ref2, such that the second node P2 is in a state of high-level, which in turns causes the sixth switching transistor T6 and the tenth switching transistor T10 to turn on. The sixth switching transistor T6 that is on causes the first switching transistor T1 to turn on. The first switching transistor T1 that is on causes the third switching transistor T3 to turn on. The third switching transistor T3 that is on conductively connects the first reference signal terminal Ref1 to the scanning signal output terminal Out2, such that the scanning signal output terminal Out2 outputs a low level signal. Meanwhile, the sixth switching transistor T6 that is on conductively connects the light emitting signal output terminal Out1 to the second reference signal terminal Ref2. Therefore, the light emitting signal output terminal Out1 outputs a high level signal. The phase C is a light emitting signal output phase.

At the phase D, Input=0, CLKB=0, CLK=1, Reset=0, Ref1=0, and Ref2=1. Since Input=0, CLKB=0, and Reset=0, the seventh switching transistor T7, the eight switching transistor T8, and the ninth switching transistor T9 all turn off. The second capacitor C2 has no discharge path, and therefore the second node P2 is still in a state of high-level. Since the first capacitor C1 has no discharge path either, and therefore the first node P1 is maintained in a state of low-level. The fact that the first node P1 is in a state of low-level causes the eleventh switching transistor T11, the fifth switching transistor T5, the fourth switching transistor T4, and the second switching transistor T2 to turn off. The fact that the second node P2 is in a state of high-level causes the sixth switching transistor T6 and the tenth switching transistor T10 to turn on. The sixth switching transistor T6 that is on causes the first switching transistor T1 to turn on. The first switching transistor T1 that is on causes the third switching transistor T3 to turn on. The third switching transistor T3 that is on conductively connects the first reference signal terminal Ref1 to the scanning signal output terminal Out2, such that the scanning signal output terminal Out2 outputs a low level signal. Meanwhile, the sixth switching transistor T6 that is on conductively connects the light emitting signal output terminal Out1 to the second reference signal terminal Ref2, such that the light emitting signal output terminal Out1 outputs a high level signal. The phase D is still a light emitting signal output phase.

No more description will be given here, and the next phase is still a light emitting signal output phase.

Figure 10:
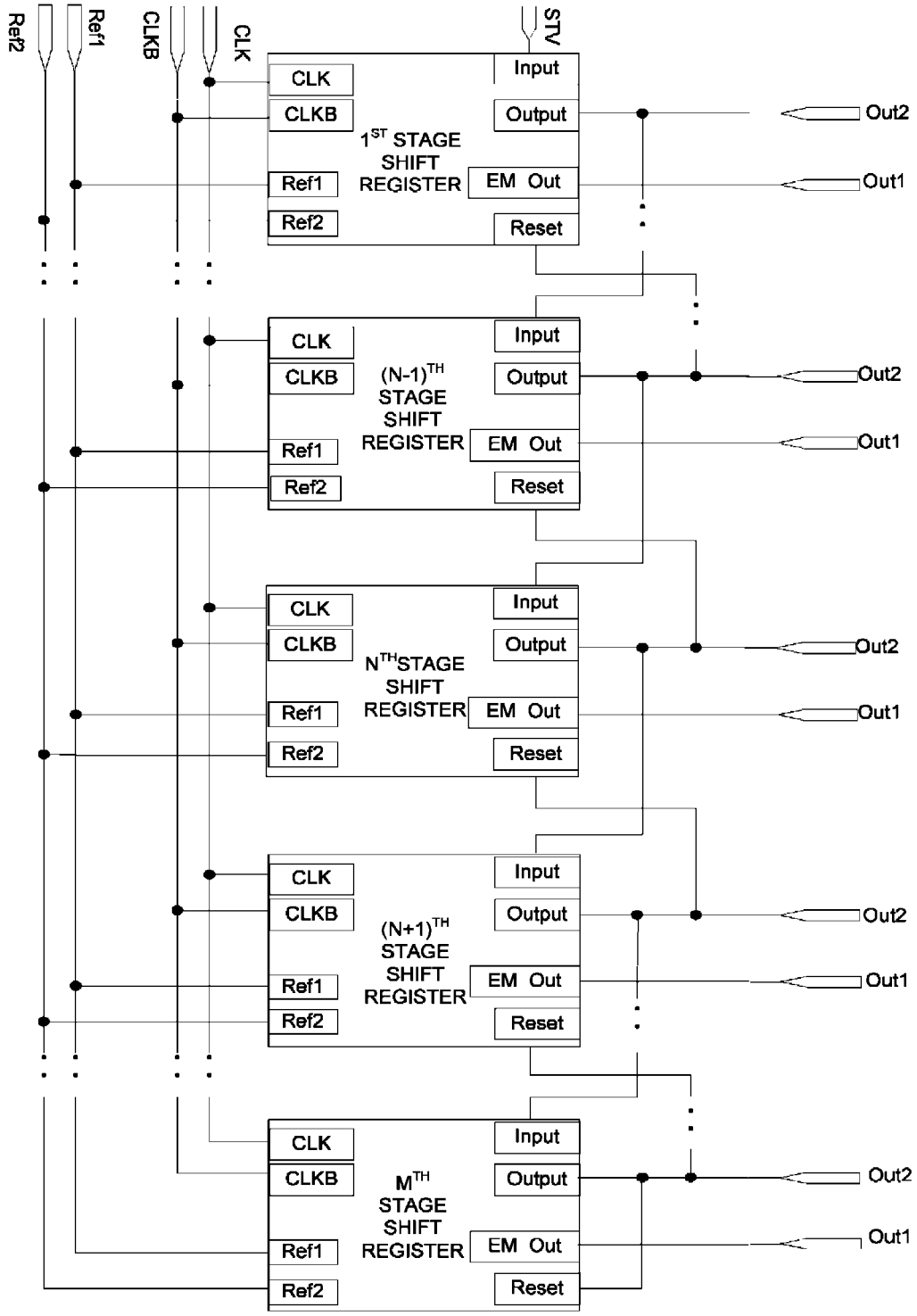
FIG. 10 is a structural diagram of a gate driver circuit provided according to an embodiment of the present disclosure.

Based on the same inventive concept, an embodiment of the present disclosure provides a gate driver circuit (as shown in FIG. 10) comprising multiple shift registers, which are connected in series, provided by an embodiment of the present disclosure. Here, the multiple shift registers comprises at least three shift registers. Except for the first shift register and the last shift register, a scanning signal output terminal Out2 of each of shift registers is connected to a signal input terminal "Input" of a next neighboring shift register, and to a reset signal terminal Reset of a previous neighboring shift register; a scanning signal output terminal Out2 of the first shift register is connected to a signal input terminal "Input" of the second shift register; and a scanning signal output terminal Out2 of the last shift register is connected to a rest signal terminal Reset of itself and a reset signal terminal Reset of the previous shift register.

In order to simplify the description, only five shift registers are shown in FIG. 10, the $1^{St}$ stage shift register, the $(N-1)^{th}$ stage shift register, the $N^{th}$ stage shift register, the $(N+1)^{th}$ stage shift register, and the $M^{th}$ stage shift register, respectively. The scanning signal output terminal Out2 of the $N^{th}$ shift register not only outputs a reset signal to the $(N-1)^{th}$ stage shift register, but also outputs a trigger signal to the $(N+1)^{th}$ stage shift register.

Embodiments according to the present disclosure provide a shift register and a gate driver circuit. At the charging phase, under the control of the first clock signal terminal and the signal input terminal, the signal input unit controls, via the first node, the light emitting signal output control unit to conductively connect the first reference signal terminal to the light emitting signal output terminal, and controls the scanning signal output control unit to conductively connect the second clock signal terminal to the scanning signal output terminal; at the scanning signal output phase, the light emitting signal output control unit conductively connects the first reference signal terminal to the light emitting signal output terminal, the scanning signal output control unit conductively connects the second clock signal terminal to the scanning signal output terminal, and the scanning signal output terminal outputs a scanning signal under the control of the second clock signal terminal to achieve the function of outputting the scanning signals; at the light emitting signal output phase, under the control of the reset signal terminal and the second reference signal terminal, the reset control unit controls, via the second node, the light emitting signal output control unit to conductively connect the second reference signal terminal to the light emitting signal output terminal such that the light emitting signal output terminal outputs a light emitting signal to achieve the function of outputting the light emitting signals, and the scanning signal output control unit conductively connects the first reference signal terminal to the scanning signal output terminal under the control of the light emitting signal output terminal. In this way, one pixel driver circuit is driven to operate by three neighboring shift registers in the gate driver circuit. The scanning signal output terminal of the first shift register inputs scanning signals into the first scanning signal input terminal of the pixel driver circuit, the scanning signal output terminal of the second shift register inputs scanning signals into the second scanning signal input terminal of the pixel driver circuit, and the light emitting signal output terminal of the third shift register inputs light emitting signals into the light emitting signal input terminal of the pixel driver circuit, thereby driving the pixel driver circuit to operate normally at various phases. Embodiments of the present disclosure provide the above shift register which integrates the function of outputting scanning signals and the function of outputting light emitting signals. In this way, the light emitting driver circuit disposed independently at rims of an OLED display panel for providing various pixel driver circuits with the light emitting signals may be omitted, and this helps in designing a display panel with narrow rims.

Obviously, one skilled in the art may make modifications and variations to the present disclosure without departing from the spirit and scope of the present disclosure. In this way, if these modifications and variants of the present disclosure belong to the scope of the claims of the present disclosure and their equivalents, the present disclosure is intended to embrace these modifications and variants.

We claim:

1. A shift register, comprising:

a signal input unit having an input terminal connected to a first reference signal terminal, a first control terminal connected to a first clock signal terminal, a second control terminal connected to a signal input terminal, a first output terminal connected to a first node, and a second output terminal connected to a second node;

a reset control unit connected to the signal input unit at the second node and having an input terminal connected to a second reference signal terminal, a control terminal connected to a reset signal terminal, and an output terminal connected to the second node;

a light emitting signal output control unit connected to the signal input unit at the first node and connected to the reset control unit at the second node and having a first input terminal connected to the first reference signal terminal, a second input terminal connected to the second reference signal terminal, a first control terminal connected to the first node, a second control terminal connected to the second node, and an output terminal connected to a light emitting signal output terminal; and a scanning signal output control unit connected to the signal input unit at the first node and connected to the light emitting signal output control unit and having a first input terminal connected to a second clock signal terminal, a second input terminal connected to the first reference signal terminal, a third input terminal connected to the second reference signal terminal, a first control terminal connected to the first node, a second control terminal connected to the output terminal of the light emitting signal output control unit, and an output terminal connected to a scanning signal output terminal, wherein at a charging phase, under the control of the first clock signal terminal and the signal input terminal, the signal input unit controls, via the first node, the light emitting signal output control unit to conductively connect the first reference signal terminal to the light emitting signal output terminal, and controls the scanning signal output control unit to conductively connect the second clock signal terminal to the scanning signal output terminal;

wherein at a scanning signal output phase, the light emitting signal output control unit conductively connects the first reference signal terminal to the light emitting signal output terminal, the scanning signal output control unit conductively connects the second clock signal terminal to the scanning signal output terminal, and the scanning signal output terminal outputs a scanning signal under the control of the second clock signal terminal;

wherein at a light emitting signal output phase, under the control of the reset signal terminal and the second reference signal terminal, the reset control unit controls, via the second node, the light emitting signal output control unit to conductively connect the second reference signal terminal to the light emitting signal output terminal such that the light emitting signal output terminal outputs a light emitting signal, and the scanning signal output control unit conductively connects the first reference signal terminal to the scanning signal output terminal under the control of the light emitting signal output terminal;

wherein the scanning signal output control unit further comprises a first control module, the first control module is configured to conductively connect the first reference signal terminal to the scanning signal output terminal at the light emitting signal output phase and comprises a first switching transistor, a second switching transistor, and a third switching transistor, wherein the first switching transistor has a gate connected to the light emitting signal output terminal, a source connected to a drain of the second switching transistor, and a drain connected to second reference signal terminal;

wherein the second switching transistor has a gate connected to first node, a source connected to the first reference signal terminal, and a drain connected to the source of the first switching transistor; and wherein the third switching transistor has a gate connected to the source of the first switching transistor and the drain of the second switching transistor, respectively, a source connected to the first reference signal terminal, and a drain connected to the scanning signal output terminal.

2. The shift register of claim 1, wherein the signal input unit comprises a seventh switching transistor and an eighth switching transistor, wherein the seventh switching transistor has a gate connected to the first clock signal terminal, a source connected to the first node, and a drain connected to the signal input terminal; and wherein the eighth switching transistor has a gate connected to the signal input terminal, a source connected to the first reference signal terminal, and a drain connected to the second node.

3. The shift register of claim 1, wherein the reset control unit comprises a ninth switching transistor and a second capacitor, wherein the ninth switching transistor has a gate connected to the reset signal terminal, a source connected to the second node, and a drain connected to the second reference signal terminal; and wherein the second capacitor is connected between the second node and the second reference signal terminal.

4. The shift register of claim 1, wherein the scanning signal output control unit further comprises a second control module connected to the first control module, and wherein the second control module has an input terminal connected to the second clock signal terminal, a control terminal connected to the first node, and an output terminal connected to the scanning signal output terminal, and conductively connecting the second clock signal terminal to the scanning signal output terminal at the charging phase and the scanning signal output phase, and causes the scanning signal output terminal to output a scanning signal at the scanning signal output phase.

5. The shift register of claim 4, wherein the second control module comprises a fourth switching transistor and a first capacitor, wherein the fourth switching transistor has a gate connected to the first node, a source connected to the second clock signal terminal, and a drain connected to the scanning signal output terminal; and wherein the first capacitor is connected between the first node and the scanning signal output terminal.

6. The shift register of claim 1, wherein the light emitting signal output control unit comprises a third control module and a fourth control module, wherein the third control module has an input terminal connected to the first reference signal terminal, a control terminal connected to the first node, and an output terminal connected to the light emitting signal output terminal, and conductively connects the first reference signal terminal to the light emitting signal output terminal at the charging phase and the scanning signal output phase; and wherein the fourth control module has an input terminal connected to the second reference signal terminal, a control terminal connected to the second node, and an output terminal connected to the light emitting signal output terminal, and conductively connects the second reference signal terminal to the light emitting signal output terminal at the light emitting signal output phase, such that the light emitting signal output terminal outputs a light emitting signal.

7. The shift register of claim 6, wherein the third control module comprises a fifth switching transistor, wherein the fifth switching transistor has a gate connected to the first node, a source connected to the first reference signal terminal, and a drain connected to the light emitting signal output terminal.

8. The shift register of claim 6, wherein the fourth control module comprises a sixth switching transistor, wherein the sixth switching transistor has a gate connected to the second node, a source connected to the light emitting signal output terminal, and a drain connected to the second reference signal terminal.

9. The shift register of claim 1, further comprising a first node maintaining unit, wherein the first node maintaining unit has an input terminal connected to the first reference signal terminal, a control terminal connected to the second node, and an output terminal connected to the first node, and maintains the potential of the first node under the control of the second node at the light emitting signal output phase.

10. The shift register of claim 9, wherein the first node maintaining unit comprises a tenth switching transistor, wherein the tenth switching transistor has a gate connected to the second node, a source connected to the first reference signal terminal, and a drain connected to the first node.

11. The shift register of claim 1, further comprising a second node maintaining unit, wherein the second node maintaining unit has an input terminal connected to the first reference signal terminal, a control terminal connected to the first node, and an output terminal connected to the second node, and maintains the potential of the second node under the control of the first node at the charging phase and the scanning signal output phase.

12. The shift register of claim 11, wherein the second node maintaining unit comprises a eleventh switching transistor, wherein the eleventh switching transistor has a gate connected to the first node, a source connected to the first reference signal terminal, and a drain connected to the second node.

13. A gate driver circuit, comprising at least three shift registers according to claim 1, which are connected in series, wherein except for the first shift register and the last shift register, a scanning signal output terminal of each of shift registers is connected to a signal input terminal of a next neighboring shift register and to a reset signal terminal of a previous neighboring shift register, wherein a scanning signal output terminal of the first shift register is connected to a signal input terminal of the second shift register; and wherein a scanning signal output terminal of the last shift register is connected to a reset signal terminal of itself and a reset signal terminal of the previous shift register.

14. The gate driver circuit of claim 13, wherein the scanning signal output control unit further comprises a second control module connected to the first control module, wherein the second control module comprises a fourth switching transistor and a first capacitor, wherein the fourth switching transistor has a gate connected to the first node, a source connected to the second clock signal terminal, and a drain connected to the scanning signal output terminal; and wherein the first capacitor is connected between the first node and the scanning signal output terminal.

15. The gate driver circuit of claim 13, wherein the light emitting signal output control unit comprises a third control module and a fourth control module, wherein the third control module comprises a fifth switching transistor, wherein the fifth switching transistor has a gate connected to the first node, a source connected to the first reference signal terminal, and a drain connected to the light emitting signal output terminal, wherein the fourth control module comprises a sixth switching transistor, and wherein the sixth switching transistor has a gate connected to the second node, a source connected to the light emitting signal output terminal, and a drain connected to the second reference signal terminal.

16. The gate driver circuit of claim 13, wherein the signal input unit comprises a seventh switching transistor and an eighth switching transistor, wherein the seventh switching transistor has a gate connected to the first clock signal terminal, a source connected to the first node, and a drain connected to the signal input terminal; and wherein the eighth switching transistor has a gate connected to the signal input terminal, a source connected to the first reference signal terminal, and a drain connected to the second node.

17. The gate driver circuit of claim 13, wherein the reset control unit comprises a ninth switching transistor and a second capacitor, wherein the ninth switching transistor has a gate connected to the reset signal terminal, a source connected to the second node, and a drain connected to the second reference signal terminal; and wherein the second capacitor is connected between the second node and the second reference signal terminal.

18. A driving method, the method being applied to a gate driver circuit according to claim 13, the method comprising:

providing, at a first clock signal terminal and a second clock signal terminal, a first clock signal and a second clock signal in antiphase, respectively; and providing, at a signal input terminal of the first shift register, an input signal that is in-phase with the first clock signal.

19. The driving method of claim 18, further comprising:

providing, at a first reference signal terminal, a first reference signal that has an opposite polarity to the input signal; and providing, at a second reference signal terminal, a second reference signal that has a same polarity as the input signal.

* * * * *